US011015281B2

(12) United States Patent
Grider et al.

(10) Patent No.: US 11,015,281 B2
(45) Date of Patent: May 25, 2021

(54) LAUNDRY APPLIANCE HAVING A MAINTENANCE FREE LINT REMOVAL SYSTEM

(71) Applicant: WHIRLPOOL CORPORATION, Benton Harbor, MI (US)

(72) Inventors: Jordan Grider, Farmington Hills, MI (US); Alexander Halbleib, St. Joseph, MI (US); Christopher A. Jones, St. Joseph, MI (US); Roy E. Masters, Jr., St. Joseph, MI (US); Rodney M. Welch, Eau Claire, MI (US); Anthony B. Welsh, St. Joseph, MI (US); Erica L. Roberts, St. Joseph, MI (US); Thomas Kessler, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 183 days.

(21) Appl. No.: 16/123,352

(22) Filed: Sep. 6, 2018

(65) Prior Publication Data

US 2019/0093279 A1 Mar. 28, 2019

Related U.S. Application Data

(60) Provisional application No. 62/563,304, filed on Sep. 26, 2017.

(51) Int. Cl.

| | |
|---|---|
| ***F26B 19/00*** | (2006.01) |
| ***D06F 58/22*** | (2006.01) |
| ***D06F 58/26*** | (2006.01) |
| ***D06F 39/10*** | (2006.01) |
| *D06F 105/28* | (2020.01) |

(52) U.S. Cl.

CPC ..... *D06F 58/22* (2013.01); *D06F 39/10* (2013.01); *D06F 58/26* (2013.01); *D06F 2105/28* (2020.02)

(58) Field of Classification Search

CPC ..... D06F 58/22; D06F 58/26; D06F 39/10; D06F 2105/28

USPC ..... 34/480, 260, 261, 265, 85

See application file for complete search history.

(56) References Cited

U.S. PATENT DOCUMENTS

| | | | | |
|---|---|---|---|---|
| 2,809,025 | A | 10/1957 | Pettyjohn | |
| 2,934,023 | A | 4/1960 | Lamkin et al. | |
| 3,031,772 | A * | 5/1962 | Sasnett | D06F 58/22 34/82 |
| 3,081,554 | A | 3/1963 | Long | |
| 3,196,553 | A | 7/1965 | Deaton et al. | |
| 3,306,596 | A | 2/1967 | Hollowell | |
| 3,342,961 | A | 9/1967 | Deaton et al. | |
| 3,653,807 | A | 4/1972 | Platt | |

(Continued)

FOREIGN PATENT DOCUMENTS

| | | |
|---|---|---|
| DE | 3147796 | 3/1983 |
| DE | 3738031 | 5/1989 |

(Continued)

*Primary Examiner* — John P McCormack

(74) *Attorney, Agent, or Firm* — Price Heneveld LLP

(57) ABSTRACT

A laundry appliance includes a drum for processing laundry. A blower delivers process air through an airflow path that includes the drum. A lint filter is positioned within the airflow path that separates particulate matter from the process air. A lint disposal mechanism removes entrapped lint particles from a surface of the lint filter.

13 Claims, 16 Drawing Sheets

(56) References Cited

U.S. PATENT DOCUMENTS

| | | | | |
|---|---|---|---|---|
| 3,953,146 | A | 4/1976 | Sowards | |
| 3,999,304 | A | 12/1976 | Doty | |
| 4,137,647 | A | 2/1979 | Clark, Jr. | |
| 4,314,409 | A * | 2/1982 | Cartier | D06F 58/22 34/604 |
| 4,669,199 | A * | 6/1987 | Clawson | D06F 58/22 34/595 |
| 4,909,040 | A | 3/1990 | Feltrin | |
| 5,285,664 | A | 2/1994 | Chang et al. | |
| 5,606,804 | A * | 3/1997 | Smith | F26B 25/009 34/261 |
| 5,628,122 | A | 5/1997 | Spinardi | |
| 6,606,869 | B2 | 8/2003 | Takahashi et al. | |
| 6,736,885 | B2 | 5/2004 | Kaiser | |
| 6,797,044 | B2 | 9/2004 | Ou Yang et al. | |
| 7,055,262 | B2 | 6/2006 | Goldberg et al. | |
| 7,117,612 | B2 | 10/2006 | Slutsky et al. | |
| 7,665,225 | B2 | 2/2010 | Goldberg et al. | |
| 7,707,860 | B2 | 5/2010 | Hong et al. | |
| 7,866,057 | B2 | 1/2011 | Grunert et al. | |
| 8,024,948 | B2 | 9/2011 | Kitamura et al. | |
| 8,056,254 | B2 | 11/2011 | Löffler et al. | |
| 8,079,157 | B2 | 12/2011 | Balerdi Azpilicueta et al. | |
| 8,182,612 | B2 | 5/2012 | Grunert | |
| 8,240,064 | B2 | 8/2012 | Steffens | |
| 8,245,347 | B2 | 8/2012 | Goldberg et al. | |
| 8,266,813 | B2 | 9/2012 | Grunert et al. | |
| 8,266,824 | B2 | 9/2012 | Steiner | |
| 8,377,224 | B2 | 2/2013 | Grunert | |
| 8,381,412 | B2 * | 2/2013 | Ahn | D06F 58/22 34/82 |
| 8,382,887 | B1 | 2/2013 | Alsaffar | |
| 8,438,750 | B2 | 5/2013 | Dittmer et al. | |
| 8,484,862 | B2 | 7/2013 | Nawrot et al. | |
| 8,572,862 | B2 | 11/2013 | TeGrotenhuis | |
| 8,615,895 | B2 | 12/2013 | Shin et al. | |
| 8,656,604 | B2 | 2/2014 | Ediger et al. | |
| 8,667,705 | B2 | 3/2014 | Shin et al. | |
| 8,789,287 | B2 | 7/2014 | Kim et al. | |
| 8,789,290 | B2 | 7/2014 | Grunert | |
| 8,857,071 | B2 | 10/2014 | Lee et al. | |
| 8,910,394 | B2 | 12/2014 | Steffens | |
| 8,915,104 | B2 | 12/2014 | Beihoff et al. | |
| 8,984,767 | B2 | 3/2015 | Grunert et al. | |
| 9,022,228 | B2 | 5/2015 | Grunert | |
| 9,027,256 | B2 | 5/2015 | Kim et al. | |
| 9,027,371 | B2 | 5/2015 | Beihoff et al. | |
| 9,052,142 | B2 | 6/2015 | Kim et al. | |
| 9,062,410 | B2 | 6/2015 | Ahn et al. | |
| 9,134,067 | B2 | 9/2015 | Ahn et al. | |
| 9,212,450 | B2 | 12/2015 | Grunert et al. | |
| 9,217,220 | B2 * | 12/2015 | Ahn | D06F 58/22 |
| 9,249,538 | B2 | 2/2016 | Bison et al. | |
| 9,580,859 | B2 * | 2/2017 | Bommels | F26B 25/007 |
| 9,803,909 | B2 | 10/2017 | Son et al. | |
| 9,803,910 | B2 | 10/2017 | Kim et al. | |
| 2005/0268623 | A1 | 12/2005 | Urakubo et al. | |
| 2010/0011608 | A1 | 1/2010 | Grunert et al. | |
| 2010/0101606 | A1 | 4/2010 | Grunert | |
| 2010/0107703 | A1 | 5/2010 | Hisano et al. | |
| 2010/0146809 | A1 | 6/2010 | Grunert et al. | |
| 2010/0154240 | A1 | 6/2010 | Grunert | |
| 2010/0212368 | A1 | 8/2010 | Kim et al. | |
| 2012/0017456 | A1 | 1/2012 | Grunert | |
| 2012/0084992 | A1 * | 4/2012 | Shin | D06F 58/22 34/82 |
| 2013/0008049 | A1 | 1/2013 | Patil | |
| 2013/0104579 | A1 | 5/2013 | Zhou | |
| 2013/0104946 | A1 | 5/2013 | Grunert et al. | |
| 2013/0212894 | A1 | 8/2013 | Kim et al. | |
| 2013/0255094 | A1 | 10/2013 | Bömmels et al. | |
| 2013/0263630 | A1 | 10/2013 | Doh et al. | |
| 2013/0276327 | A1 | 10/2013 | Doh et al. | |
| 2013/0318813 | A1 | 12/2013 | Hong et al. | |
| 2013/0340797 | A1 | 12/2013 | Bömmels et al. | |
| 2014/0026433 | A1 | 1/2014 | Bison et al. | |
| 2014/0075682 | A1 | 3/2014 | Filippetti et al. | |
| 2014/0190032 | A1 | 7/2014 | Lee et al. | |
| 2015/0064069 | A1 | 3/2015 | Yi et al. | |
| 2016/0010271 | A1 | 1/2016 | Shin et al. | |
| 2016/0083894 | A1 | 3/2016 | Bison et al. | |
| 2016/0083896 | A1 | 3/2016 | Ryoo et al. | |
| 2016/0115636 | A1 | 4/2016 | Kim et al. | |
| 2016/0115639 | A1 | 4/2016 | Kim et al. | |
| 2017/0037560 | A1 | 2/2017 | Shin et al. | |
| 2017/0246333 | A1 | 8/2017 | Carbone et al. | |
| 2017/0307280 | A1 | 10/2017 | Schmidt et al. | |

FOREIGN PATENT DOCUMENTS

| | | |
|---|---|---|
| DE | 4304372 | 8/1994 |
| DE | 10002742 | 6/2001 |
| DE | 10002743 | 8/2001 |
| DE | 10116238 | 3/2005 |
| DE | 102006018469 | 10/2007 |
| DE | 102007052835 | 5/2009 |
| DE | 102008033388 | 1/2010 |
| DE | 102008054832 | 7/2010 |
| DE | 102009046921 | 5/2011 |
| DE | 102012223777 | 6/2014 |
| DE | 112012006737 | 4/2015 |
| EP | 468573 | 1/1992 |
| EP | 1055767 | 8/2003 |
| EP | 2134896 | 12/2009 |
| EP | 2202349 | 6/2010 |
| EP | 2341178 | 7/2011 |
| EP | 2386679 | 11/2011 |
| EP | 2324152 | 12/2011 |
| EP | 2559805 | 2/2013 |
| EP | 1987190 | 3/2013 |
| EP | 2581489 | 4/2013 |
| EP | 2708636 | 3/2014 |
| EP | 2708639 | 3/2014 |
| EP | 2966215 | 1/2016 |
| EP | 3015594 | 5/2016 |
| GB | 2087029 | 5/1982 |
| JP | 2006187449 | 7/2006 |
| JP | 2008259665 | 10/2008 |
| JP | 2013085687 | 5/2013 |
| KR | 20100031929 | 3/2010 |
| KR | 20110125570 | 11/2011 |
| WO | 2005032322 | 4/2005 |
| WO | 2007013327 | 2/2007 |
| WO | 2007093461 | 8/2007 |
| WO | 2008077708 | 7/2008 |
| WO | 2008110451 | 9/2008 |
| WO | 2009031812 | 3/2009 |
| WO | 2009059874 | 5/2009 |
| WO | 2009077291 | 6/2009 |
| WO | 2010028992 | 3/2010 |
| WO | 2010071355 | 6/2010 |
| WO | 2010102892 | 9/2010 |
| WO | 2010112321 | 10/2010 |
| WO | 2010118939 | 10/2010 |
| WO | 2011057954 | 5/2011 |
| WO | 2011061068 | 5/2011 |
| WO | 2012022655 | 2/2012 |
| WO | 2012022803 | 2/2012 |
| WO | 2012093059 | 7/2012 |
| WO | 2012101028 | 8/2012 |
| WO | 2012134149 | 10/2012 |
| WO | 2012138136 | 10/2012 |
| WO | 2013129779 | 9/2013 |
| WO | 2013144763 | 10/2013 |
| WO | 2013144764 | 10/2013 |
| WO | 2014001950 | 1/2014 |
| WO | 2014040923 | 3/2014 |
| WO | 2014041097 | 3/2014 |
| WO | 2014102317 | 7/2014 |
| WO | 2014102322 | 7/2014 |
| WO | 2015028270 | 3/2015 |
| WO | 2015074837 | 5/2015 |
| WO | 2015101386 | 7/2015 |

(56) References Cited

FOREIGN PATENT DOCUMENTS

| | | |
|---|---|---|
| WO | 2015101387 | 7/2015 |
| WO | 2015101388 | 7/2015 |
| WO | 2015101892 | 7/2015 |
| WO | 2015101892 | 9/2015 |
| WO | 2015160172 | 10/2015 |
| WO | 2016006900 | 1/2016 |
| WO | 2016045173 | 3/2016 |
| WO | 2016085432 | 6/2016 |
| WO | 2016095970 | 6/2016 |
| WO | 2016204414 | 12/2016 |
| WO | 2017023122 | 2/2017 |

* cited by examiner

LAUNDRY APPLIANCE HAVING A MAINTENANCE FREE LINT REMOVAL SYSTEM

CROSS-REFERENCE TO RELATED APPLICATION

This application claims priority to and the benefit under 35 U.S.C. § 119(e) of U.S. Provisional Patent Application No. 62/563,304, filed on Sep. 26, 2017, entitled LAUNDRY APPLIANCE HAVING A MAINTENANCE FREE LINT REMOVAL SYSTEM, the entire disclosure of which is hereby incorporated herein by reference.

FIELD OF THE DEVICE

The device is in the field of laundry appliances, and more specifically, laundry appliances having a lint removal system that requires a minimal amount of user intervention for removing lint from the laundry appliance.

SUMMARY

In at least one aspect, a laundry appliance includes a drum for processing laundry. A blower delivers process air through an airflow path that includes the drum. A lint filter is positioned within the airflow path that separates particulate matter from the process air. A lint disposal mechanism removes entrapped lint particles from a surface of the lint filter.

In at least another aspect, a laundry appliance includes a rotating drum for processing laundry. An airflow path is in communication with the rotating drum. A blower is positioned proximate the airflow path wherein the blower moves process air through the rotating drum and the airflow path for capturing moisture and particulate material from the laundry within the rotating drum. A lint separator is positioned within the airflow path that removes the particulate material from the process air to define captured particulate material. A lint disposal mechanism removes the captured particulate material from the lint separator.

In at least another aspect, a laundry appliance includes a drum for processing laundry. A blower delivers process air through an airflow path that includes the drum. The process air transports particulate material from the drum and into the airflow path. A lint separator is positioned within the airflow path that separates the particulate material from the process air. A lint disposal mechanism removes entrapped lint particles from the lint separator.

These and other features, advantages, and objects of the present device will be further understood and appreciated by those skilled in the art upon studying the following specification, claims, and appended drawings.

DETAILED DESCRIPTION OF EMBODIMENTS

Figure 1:
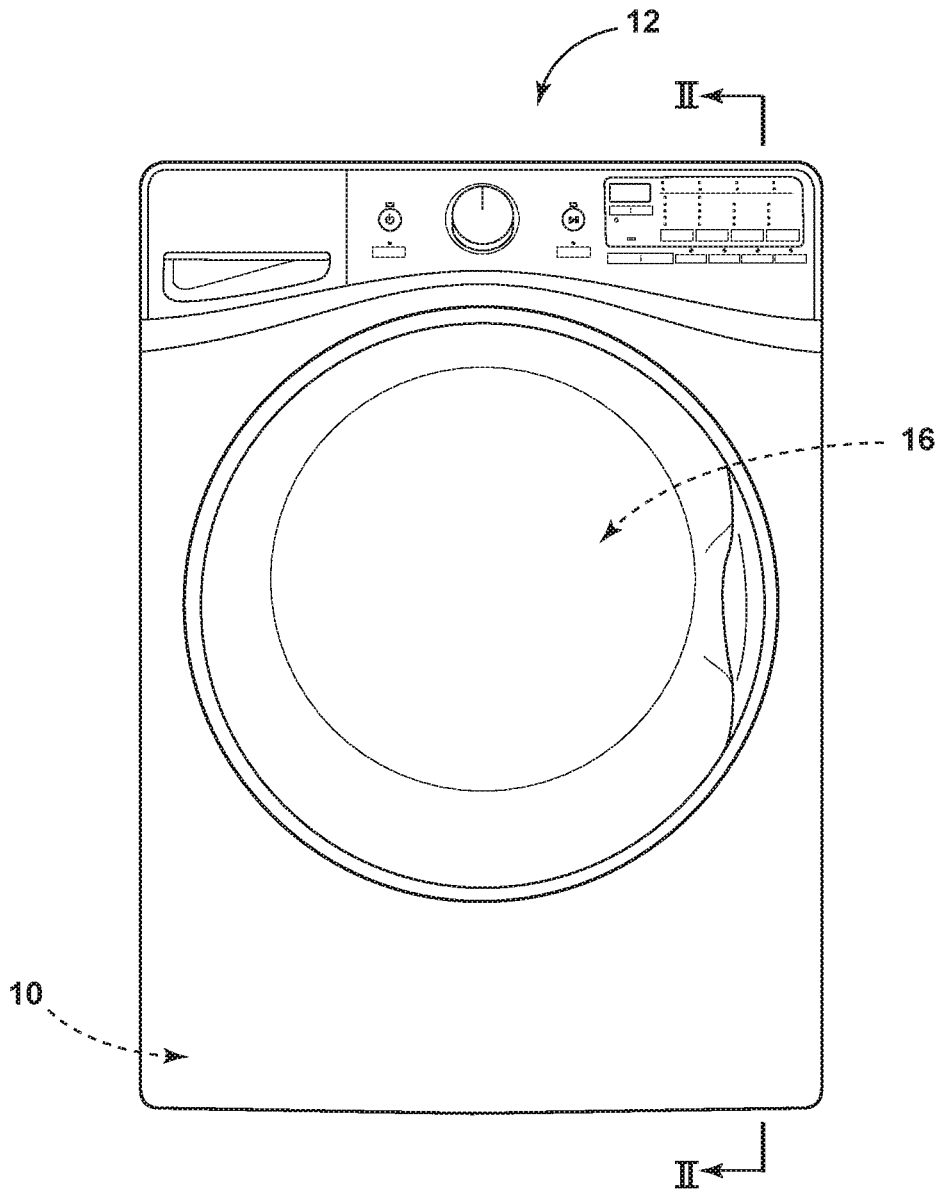
FIG. 1 is a front elevational view of a laundry appliance incorporating an aspect of the maintenance free lint removal system.
Figure 2:
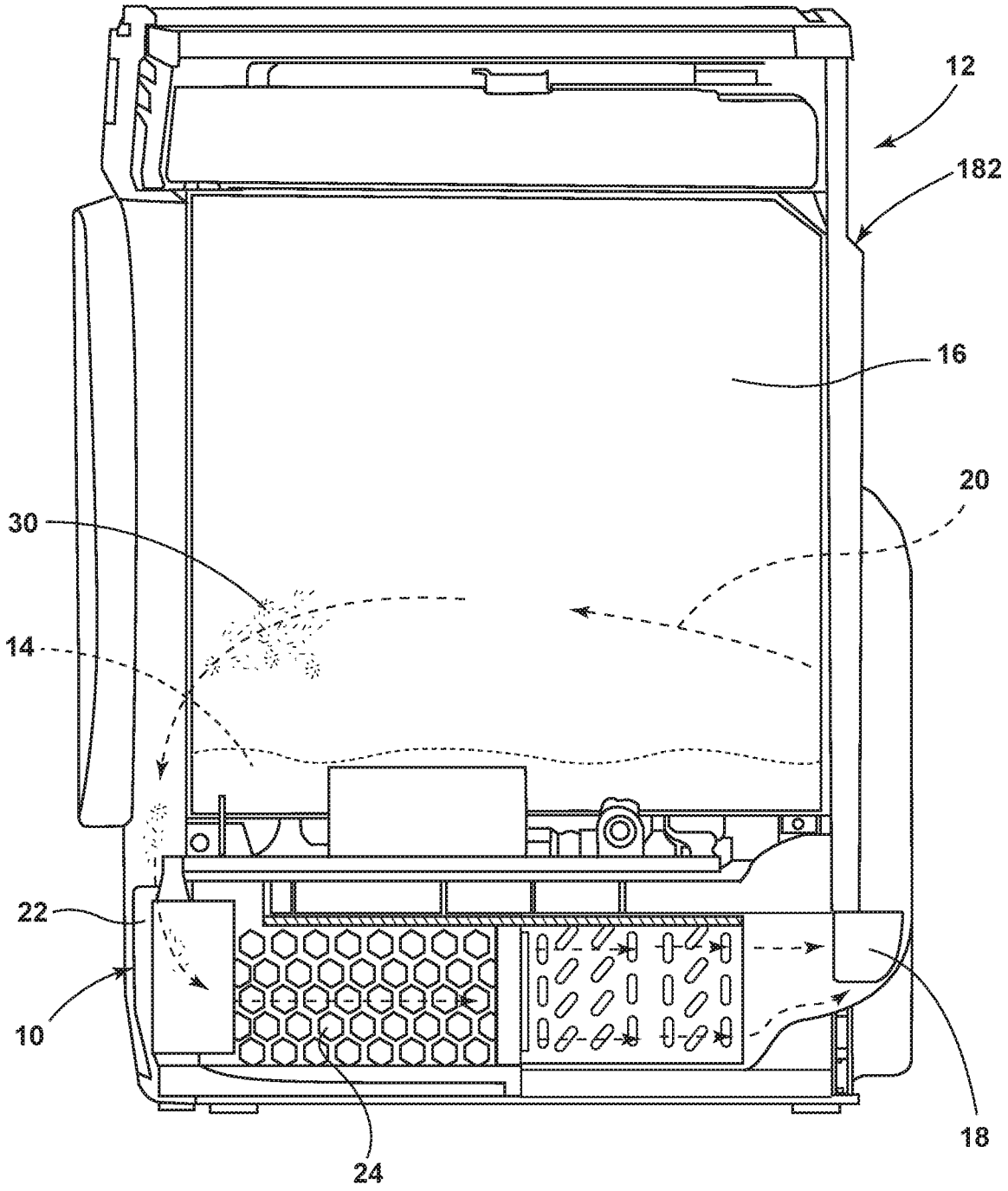
FIG. 2 is a cross-sectional view of the laundry appliance of FIG. 1, taken along line II-II.
Figure 3:
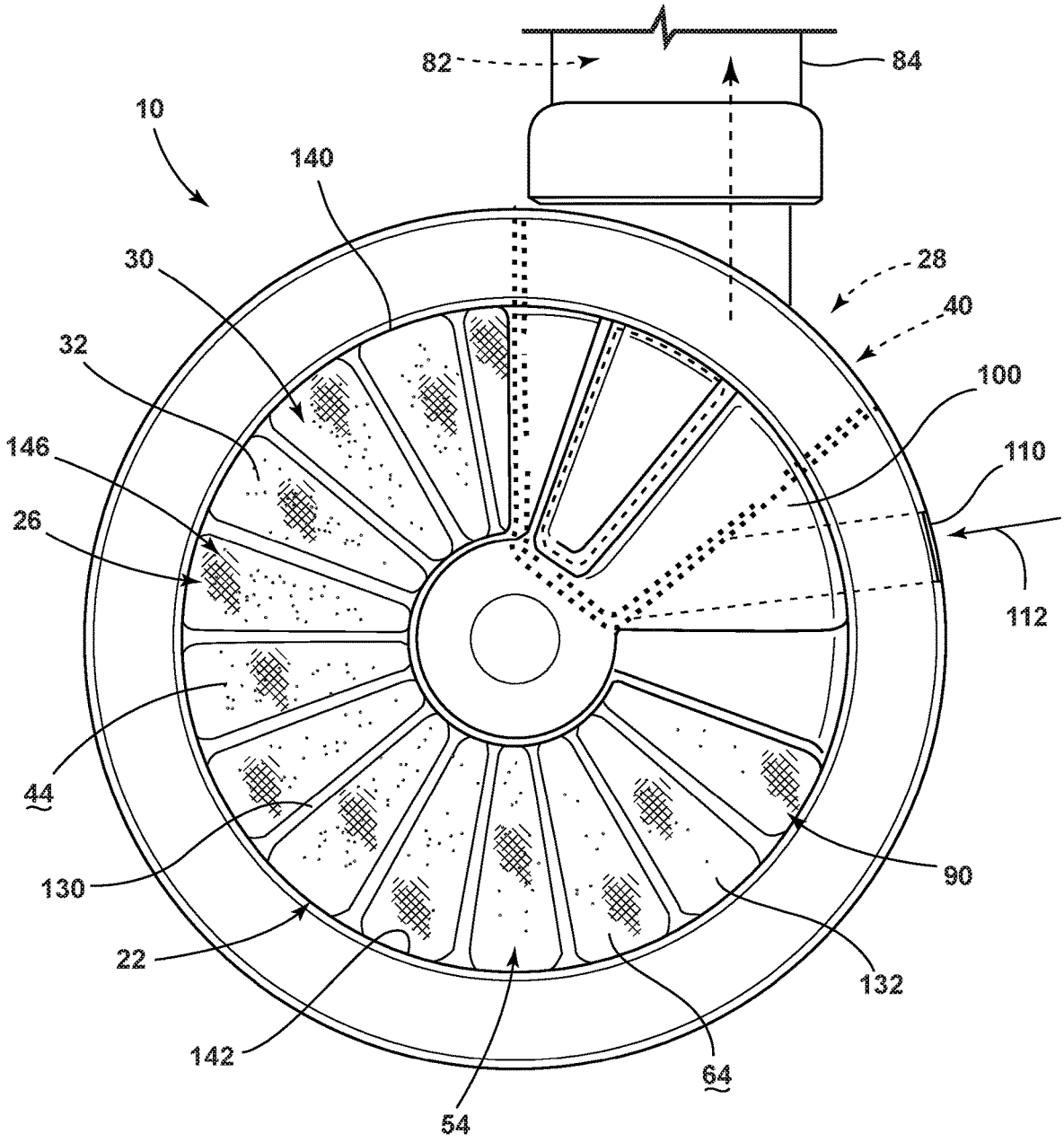
FIG. 3 is a front elevational view of an aspect of the lint disposal mechanism.
Figure 4:
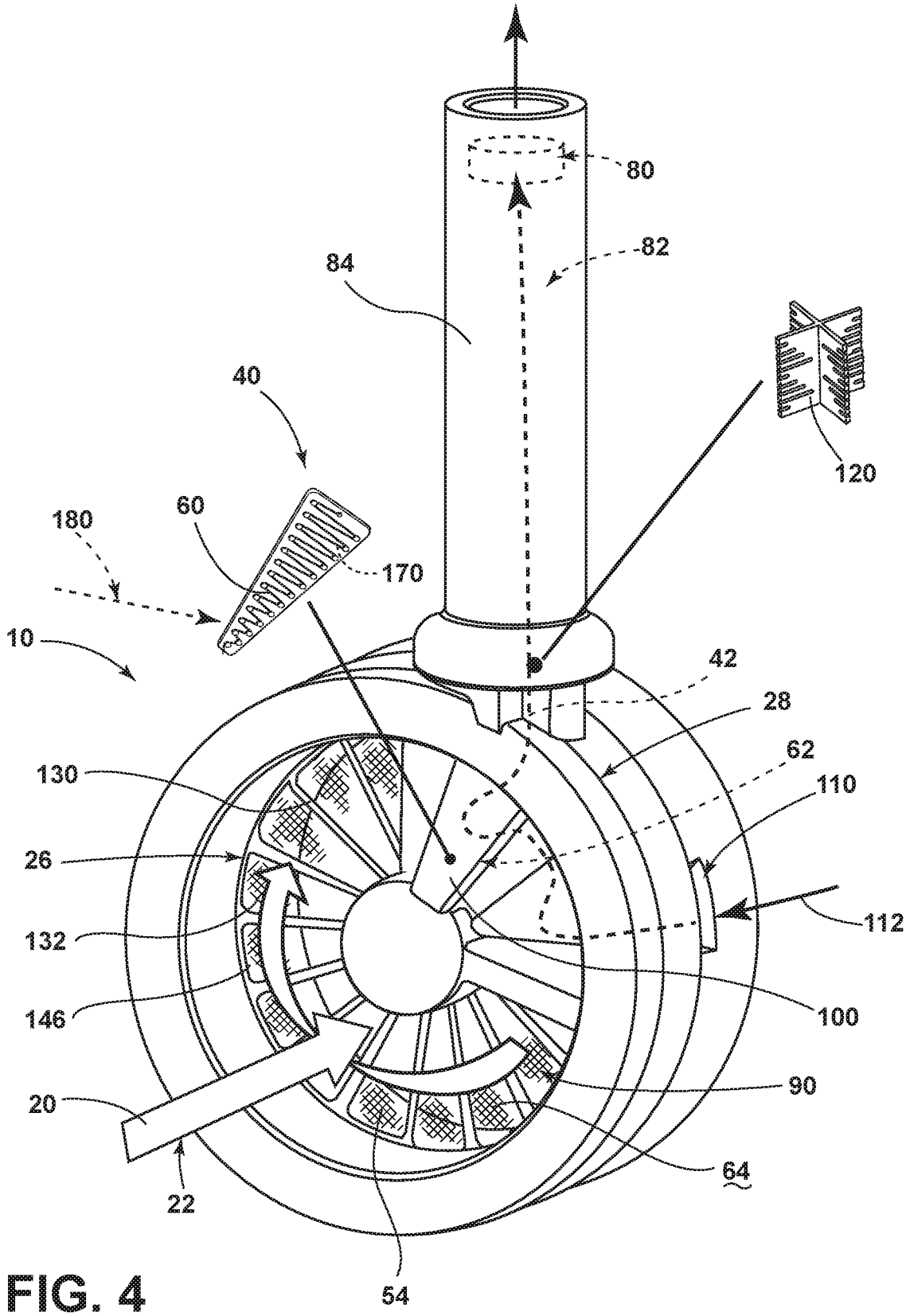
FIG. 4 is a partially-exploded perspective view of an aspect of the lint disposal mechanism of FIG. 3.
Figure 5:
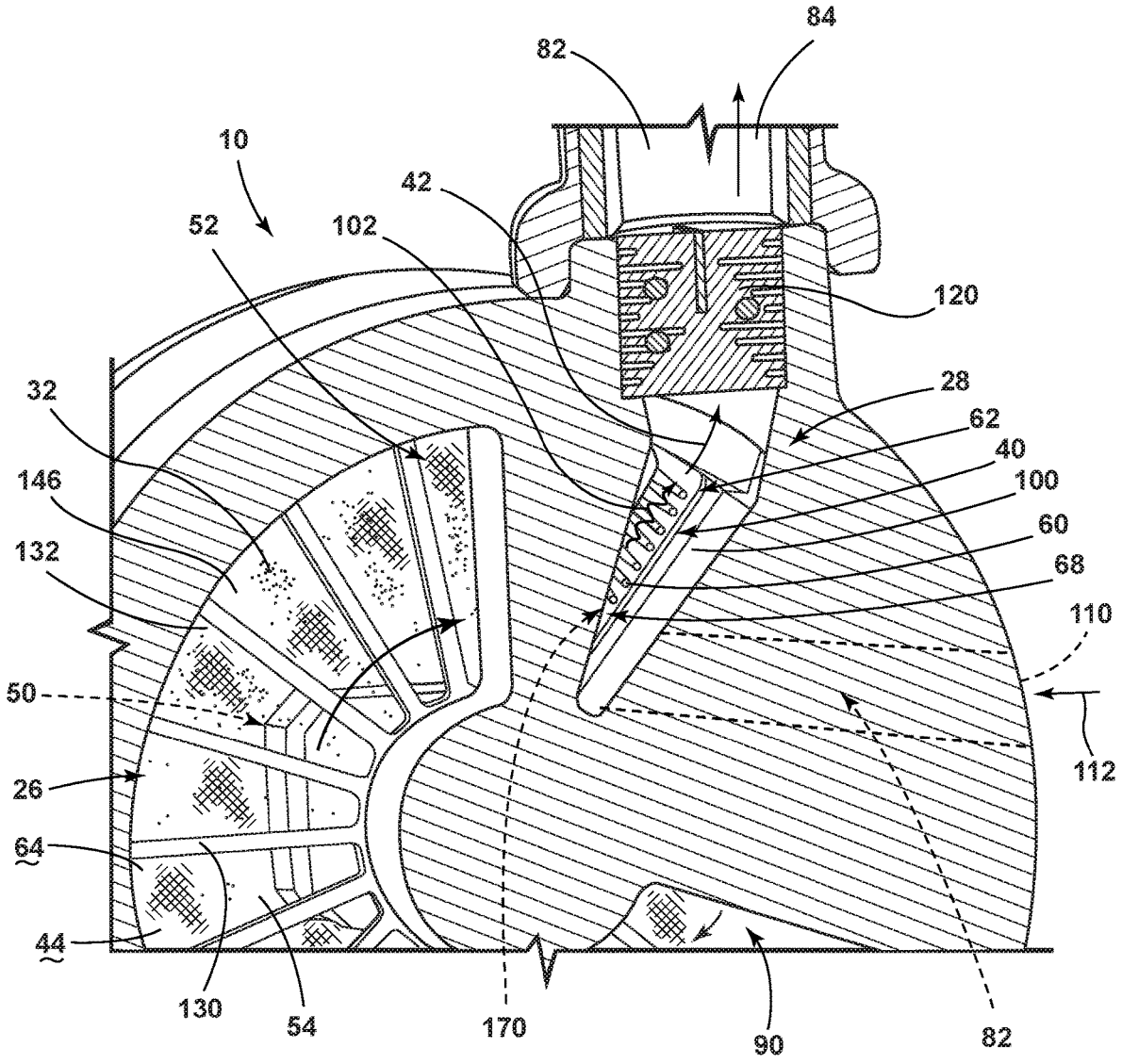
FIG. 5 is a cross-sectional view of the lint disposal mechanism of FIG. 3.
Figure 6:
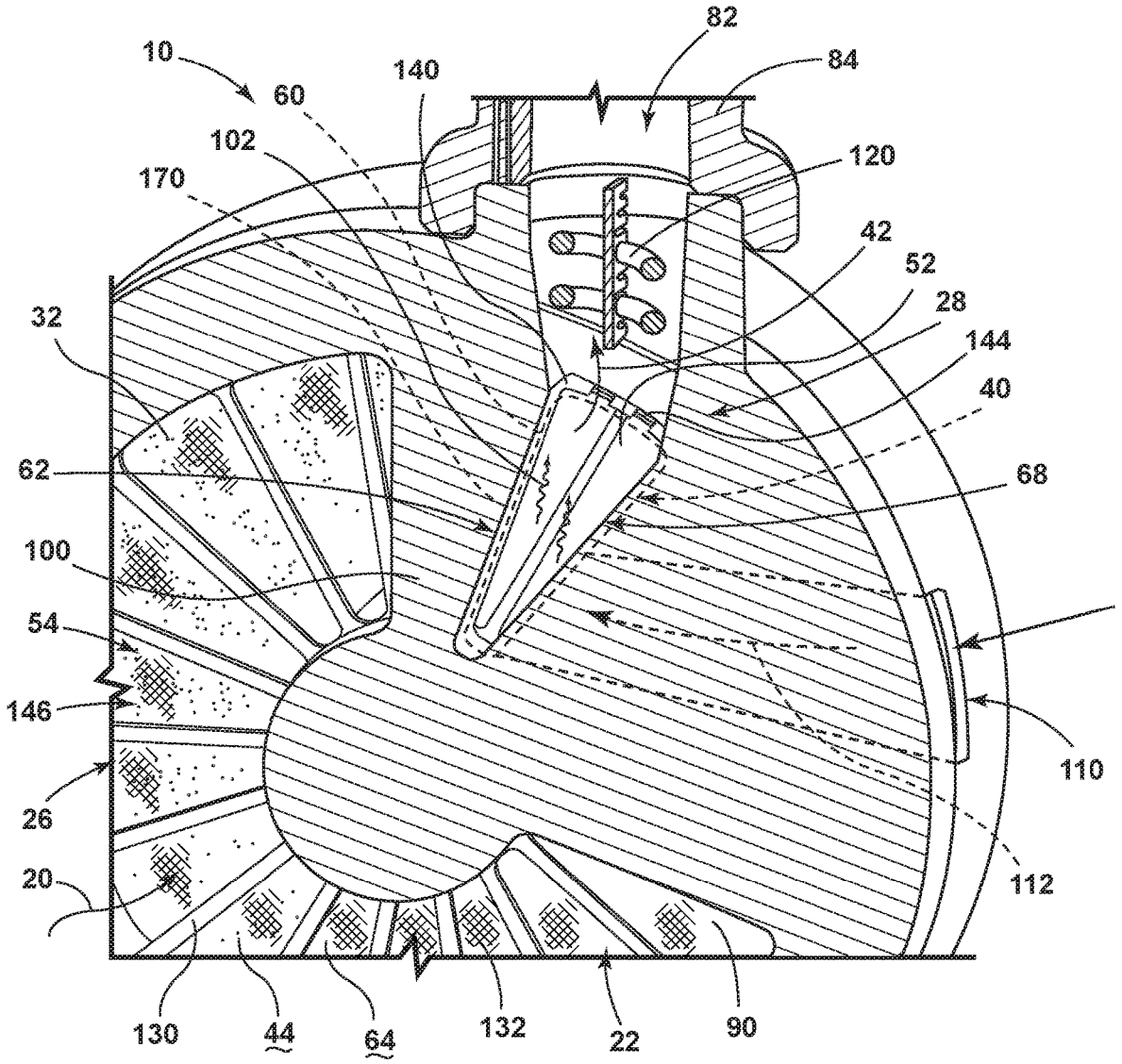
FIG. 6 is a cross-sectional view of the lint disposal mechanism of FIG. 3.
Figure 7:
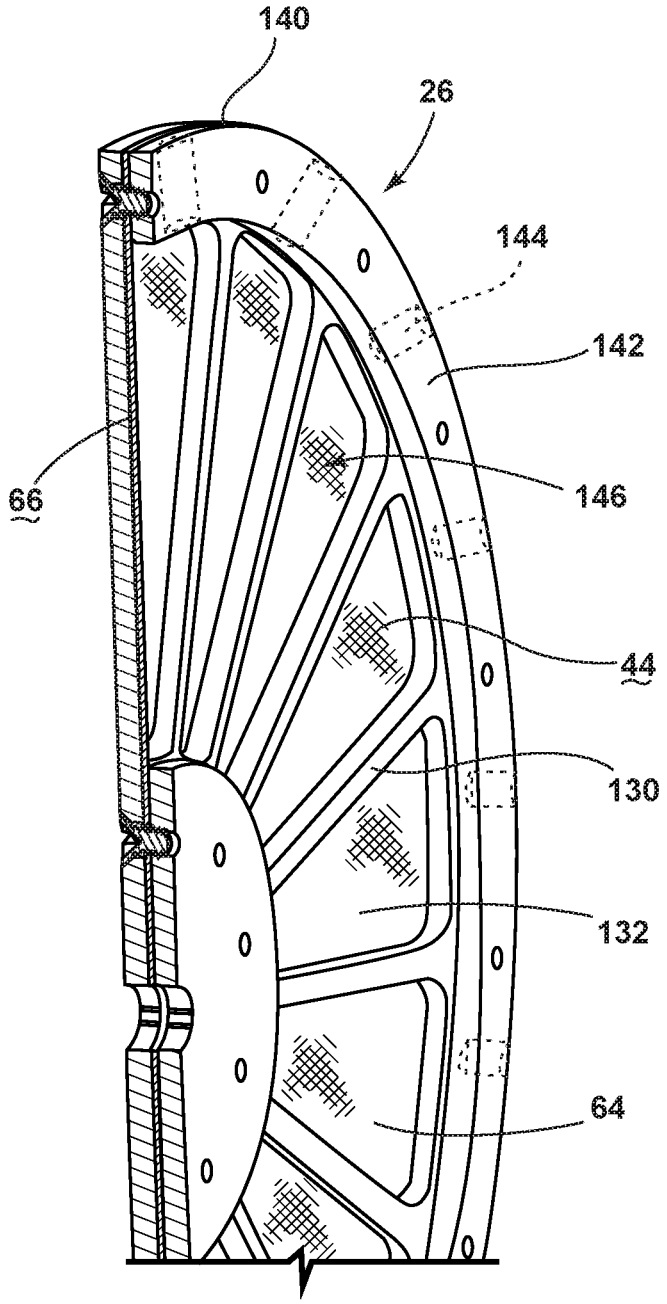
FIG. 7 is a cross-sectional view of an aspect of the lint filter used within the lint disposal mechanism of FIG. 3.
Figure 8:
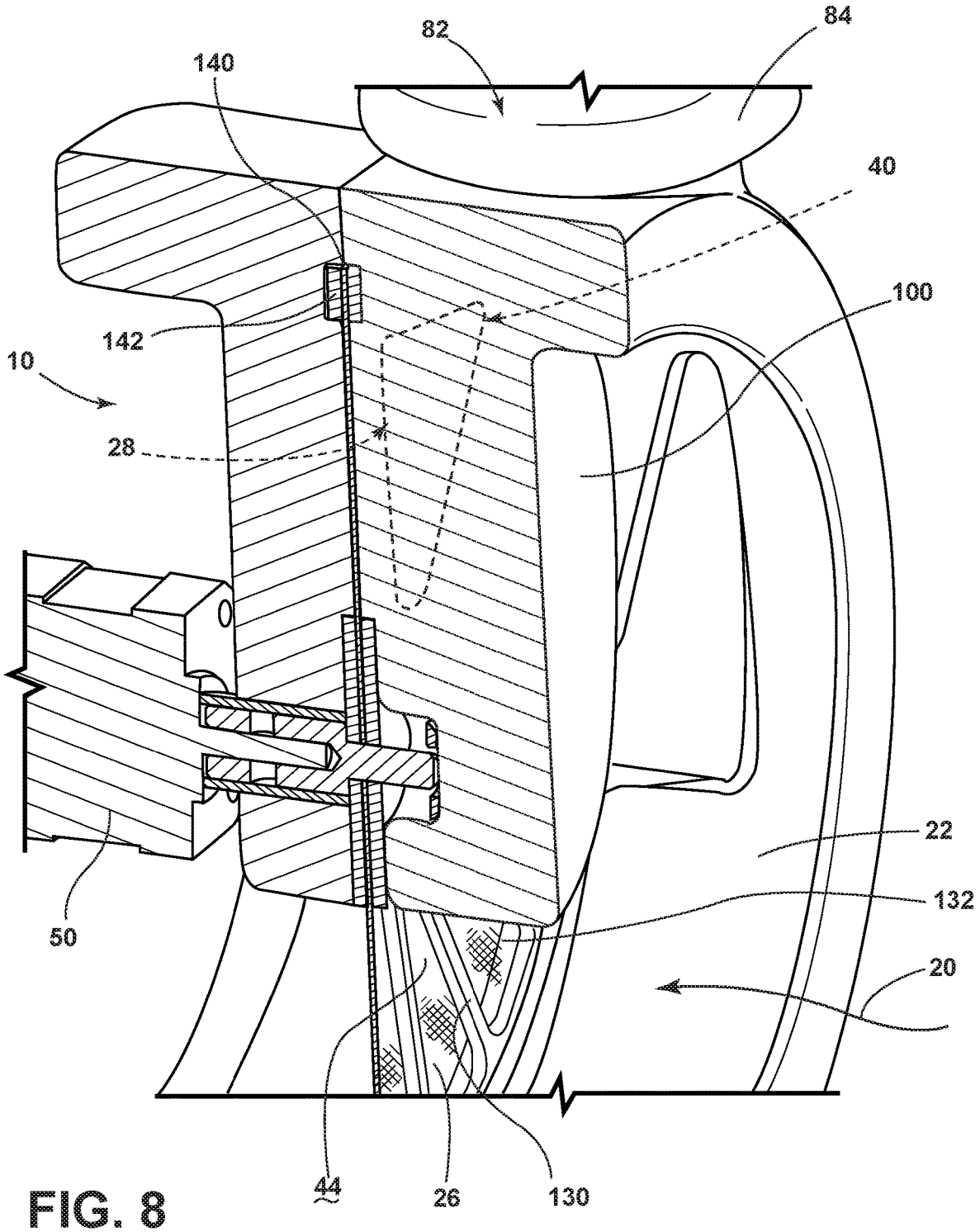
FIG. 8 is a cross-sectional view of the lint disposal mechanism of FIG. 3.
Figure 9:
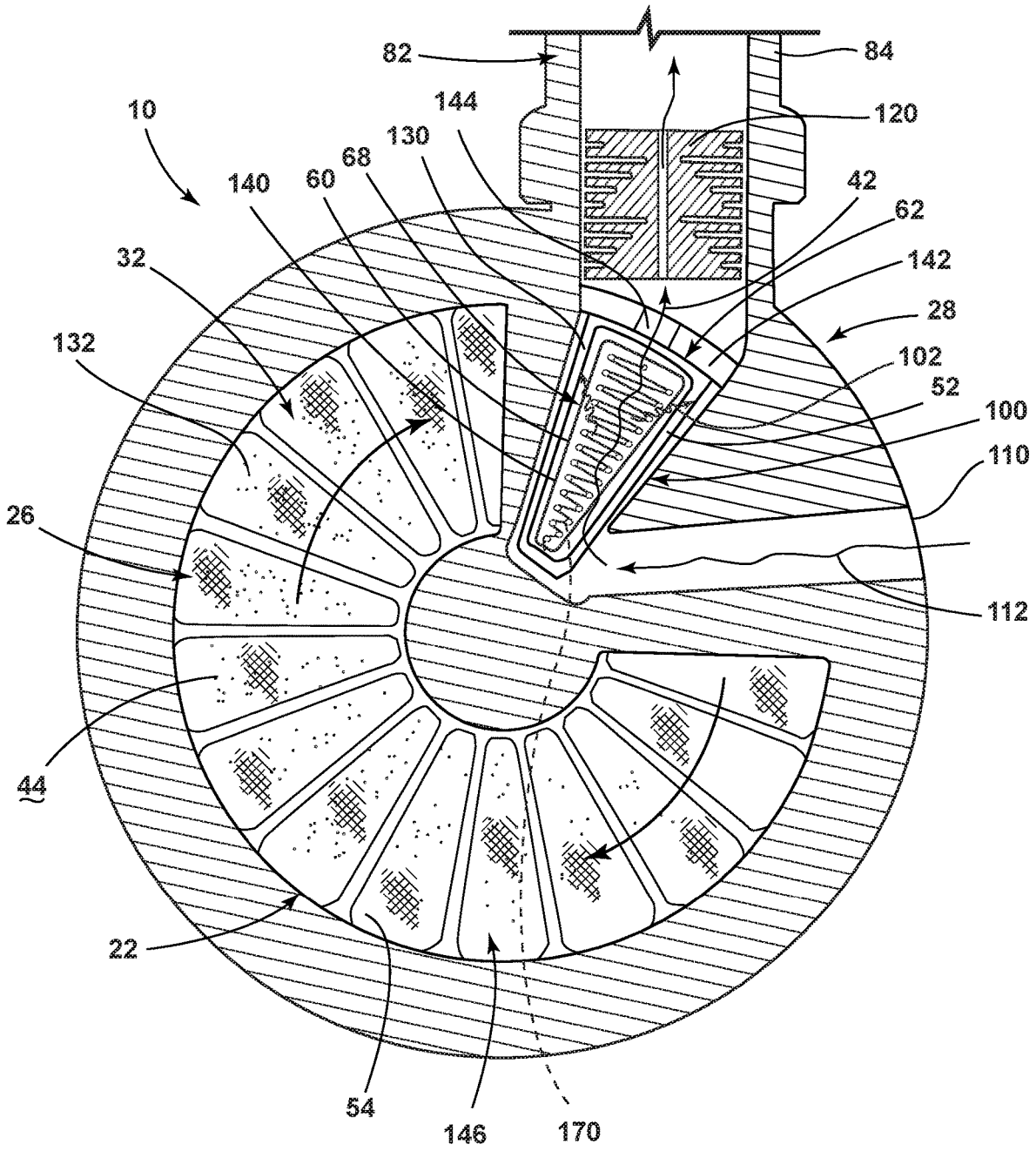
FIG. 9 is a cross-sectional view of the lint disposal mechanism of FIG. 3.
Figure 10:
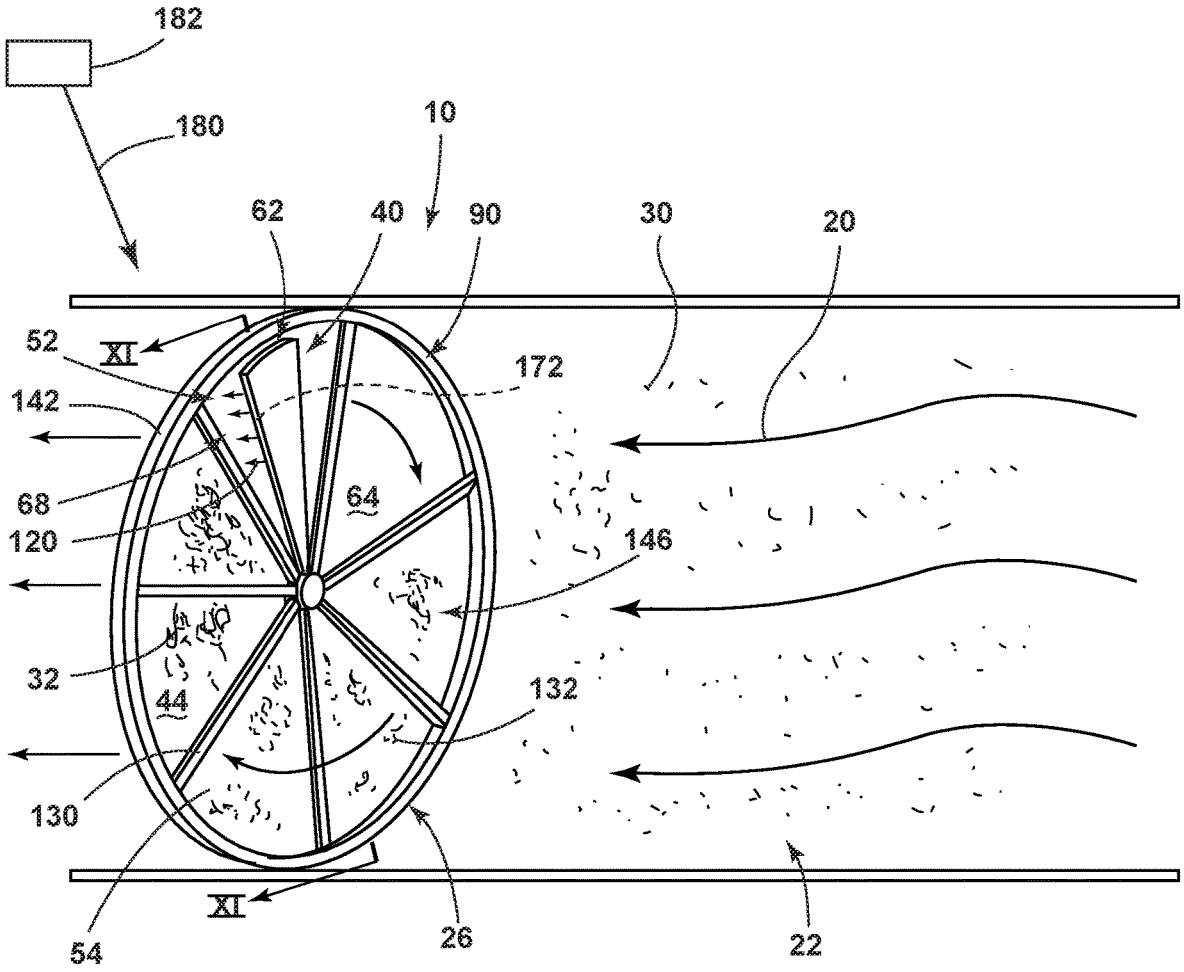
FIG. 10 is a schematic representation of the lint disposal mechanism incorporating an incineration mechanism that acts upon a portion of the lint filter.
Figure 12:
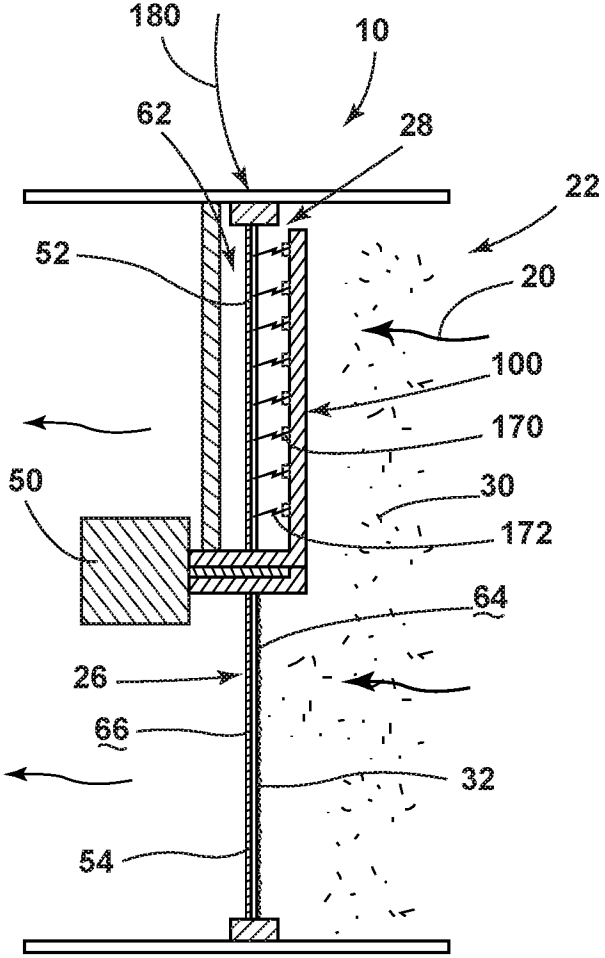
FIG. 12 is a schematic cross-sectional view of an aspect of the lint disposal system incorporating electrodes that generate an arcing electrical current for causing oxidation of lint particles.
Figure 11:
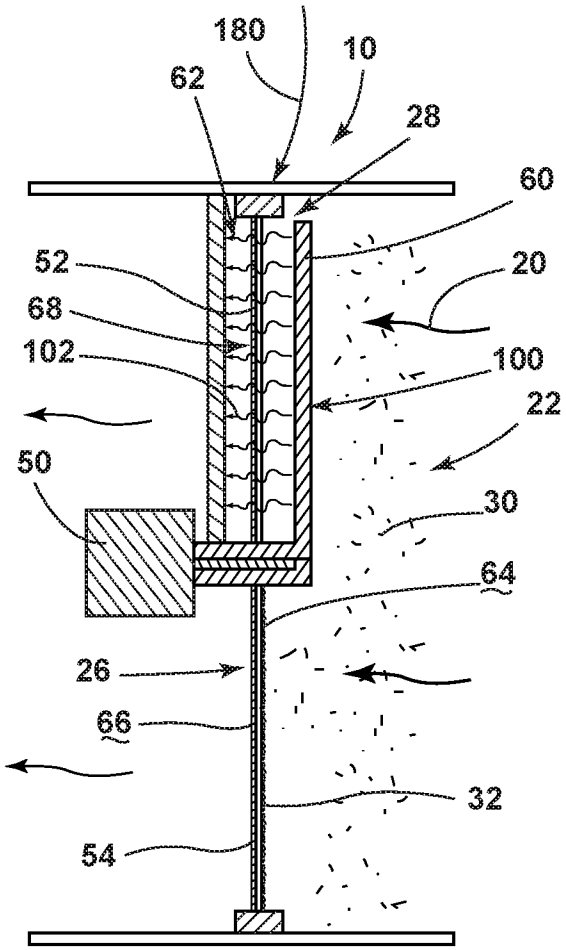
FIG. 11 is a schematic cross-sectional view of an aspect of the lint disposal mechanism showing an incineration mechanism that utilizes heat for incinerating lint particles.
Figure 15:
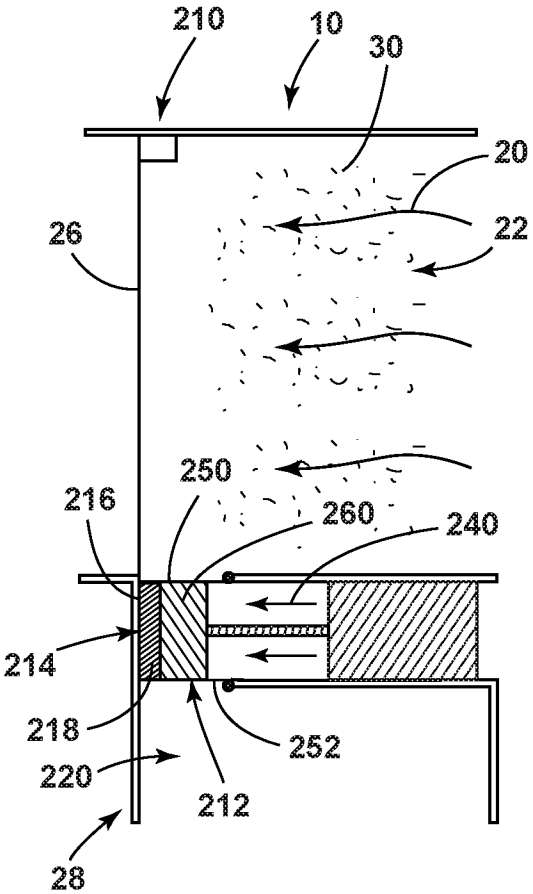
FIG. 15 is a schematic cross-sectional view of the lint disposal mechanism of FIG. 14 showing operation of the lint compactor.
Figure 14:
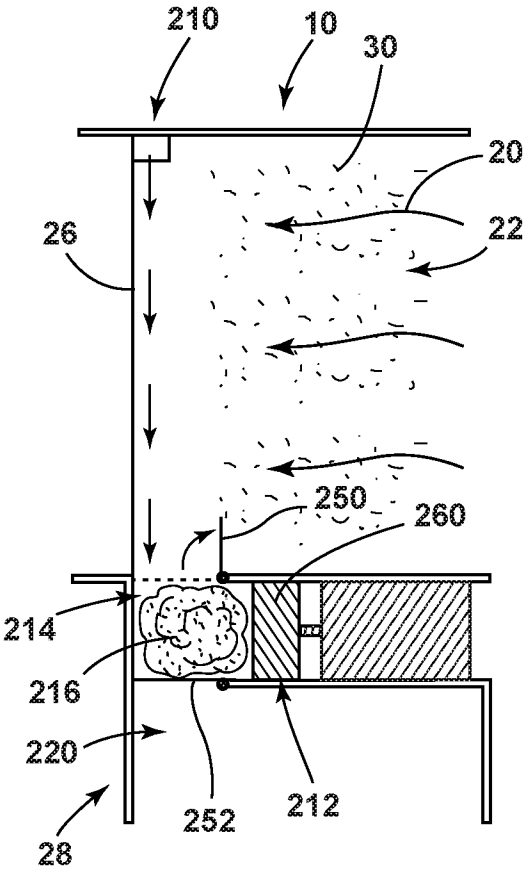
FIG. 14 is a schematic cross-sectional view of the lint disposal mechanism of FIG. 13 showing placement of the lint particles within the lint compactor.
Figure 13:
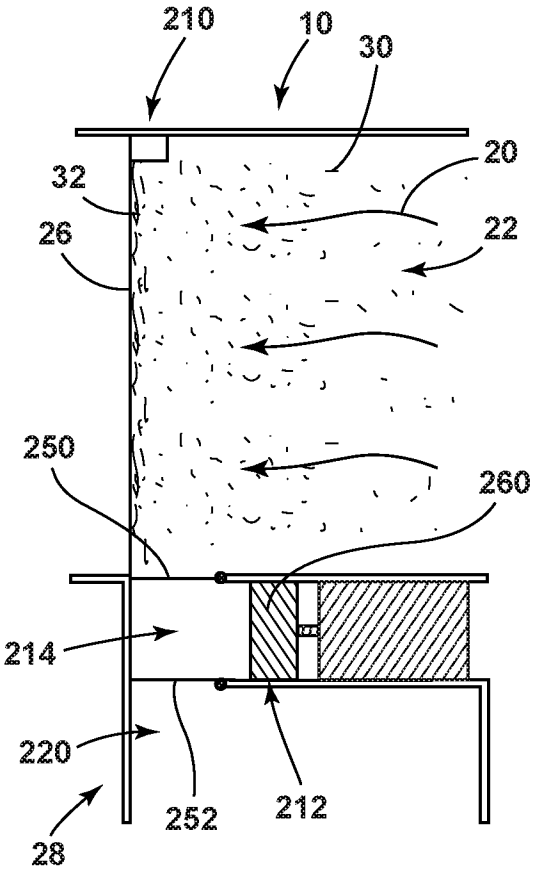
FIG. 13 is a schematic cross-sectional view of an aspect of the lint disposal mechanism incorporating a lint compactor.
Figure 16:
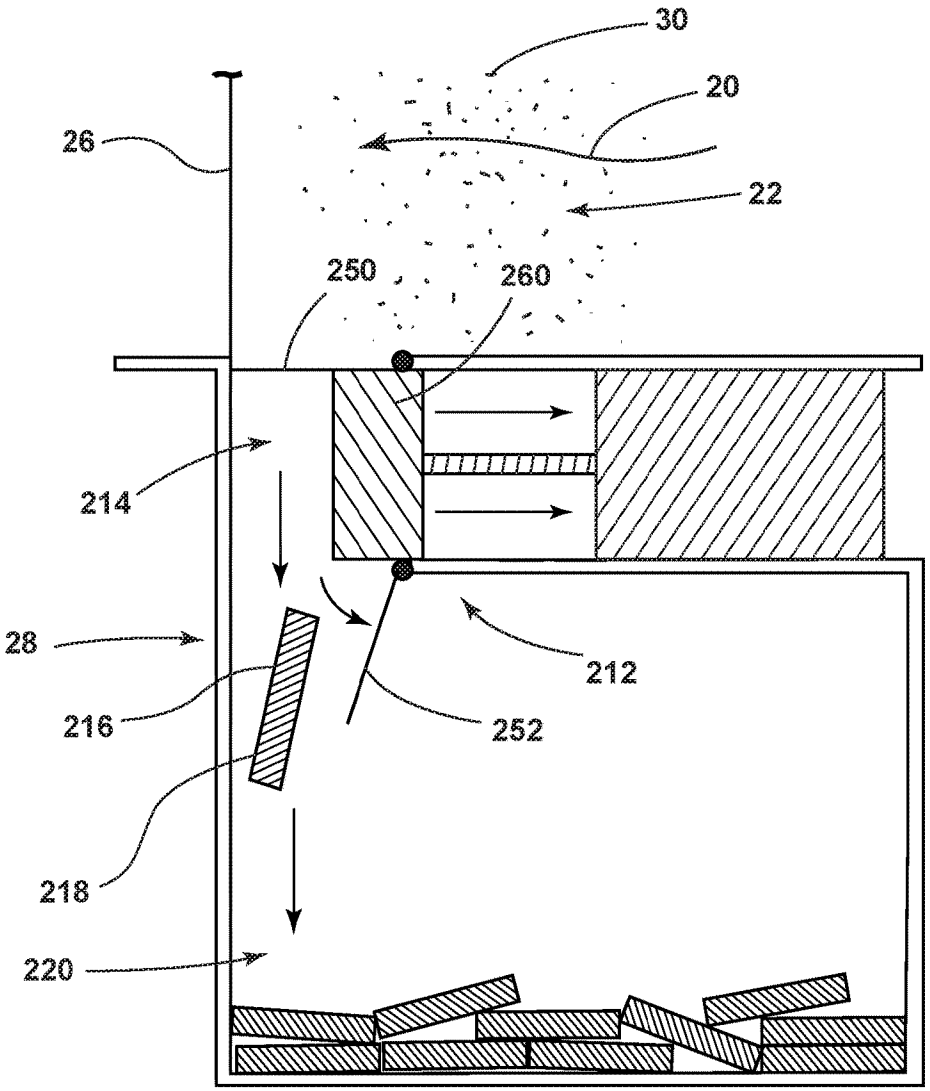
FIG. 16 is a schematic cross-sectional view of the lint compactor of FIG. 15 showing disposal of the compacted lint within a holding compartment.
Figure 17:
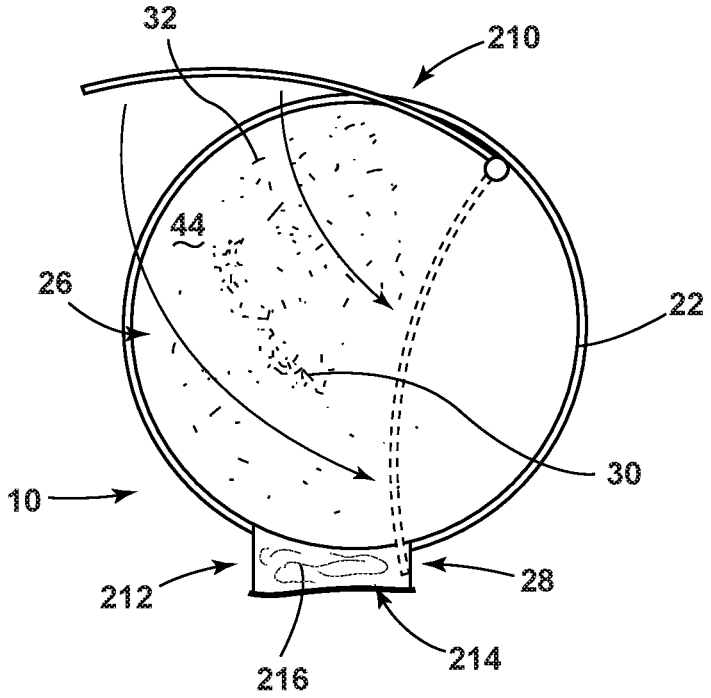
FIG. 17 is a schematic elevational view of a lint scraper that disposes lint particles into a compacting chamber.
Figure 18:
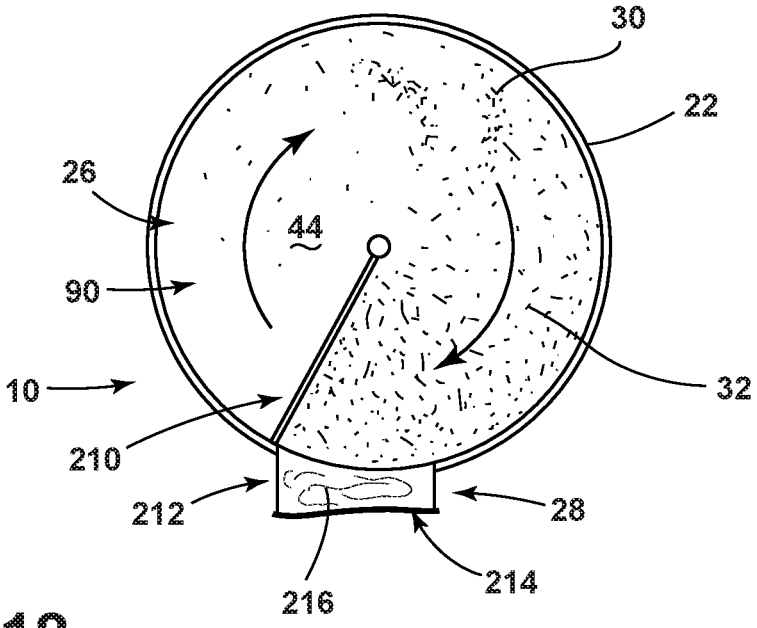
FIG. 18 is a schematic elevational view of an aspect of a lint scraper that disposes lint particles into a compacting chamber.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-19, reference numeral 10 generally refers to a lint removal system that is incorporated within a laundry appliance 12, typically a drying appliance. The laundry appliance 12 can include various mechanisms for washing, drying, or otherwise processing laundry 14. Typically, the laundry appliance 12 includes the rotating drum 16 for processing laundry 14. A blower 18 is disposed within the laundry appliance 12 and delivers process air 20 through an airflow path 22 of the laundry appliance 12. The blower 18 can be a fan, an air handling unit or other air moving device that can move process air 20 through the drum 16 using positive pressure or negative pressure via an induced flow of process air 20 through the drum 16. The airflow path 22 can include the rotating drum 16 and can also include various air-conditioning mechanisms 24. These air-conditioning mechanisms 24 can include one or more heat exchangers, electrical heaters, and other similar mechanisms that serve to heat and cool the process air 20 within the laundry appliance 12. A lint filter 26 of the lint removal system 10 is positioned within the airflow path 22. The lint filter 26 is positioned as part of a lint disposal mechanism 28 to separate particulate matter, such as lint particles 30, from the process air 20. The lint disposal mechanism 28 is included within the lint removal system 10 to separate and dispose of entrapped lint 32 from a surface 44 of the lint filter 26. According to various aspects of the device, the lint removal system 10 may be operated without a conventional filter. In such an embodiment, the lint disposal mechanism 28 operates to eliminate lint from an area where captured lint particles 30 are stored for disposal.

The lint disposal mechanism 28 is configured to operate continuously or substantially continuously throughout a particular drying cycle of the appliance 12. Through this continuous operation, the surface 44 of the lint filter 26 is allowed to remain substantially unobstructed by entrapped lint 32. Lint particles 30 that become entrapped within the lint filter 26 are removed by the lint disposal mechanism 28 shortly thereafter. Accordingly, portions of the lint filter 26 are continuously cleaned so that the process air 20 can move relatively freely through the lint filter 26 throughout the drying cycle. The continuous operation of the lint disposal mechanism 28 also provides for a maintenance-free lint removal system 10 of the appliance 12 that requires little, if any, customer intervention in the form of maintenance.

As exemplified in FIGS. 3-12, the lint disposal mechanism 28 can include an incinerating mechanism 40 that operates to burn off, degrade, incinerate or otherwise convert particles of entrapped lint 32 into a gas byproduct 42. During operation of the laundry appliance 12, lint particles 30 are captured within the process air 20 as the process air 20 moves through the rotating drum 16. These lint particles 30 continue through the airflow path 22 and are ultimately captured as entrapped lint 32 within a surface 44 of the lint filter 26. The lint disposal mechanism 28 can be an operable member that moves the lint filter 26, or moves with respect to the lint filter 26, so that the incinerating mechanism 40 can act on various portions of the lint filter 26 over time.

As exemplified in FIGS. 3-12, the lint filter 26 can be a rotating lint filter 26 that is attached to a motor 50. The motor 50 operates to rotate the lint filter 26 with respect to the incinerating mechanism 40. As lint particles 30 are entrapped on the surface 44 of the lint filter 26, the lint filter 26 is rotated so that successive portions of the surface 44 of the lint filter 26 are acted upon by the incinerating mechanism 40. Typically, a small localized portion 52 of the lint filter 26 is engaged by the incinerating mechanism 40. In this manner, the majority of the lint filter 26 defines an exposed portion 54 within the airflow path 22. The exposed portion 54 of the lint filter 26 continues to capture additional lint particles 30 from the process air 20. This entrapped lint 32 is rotated along with the lint filter 26 and is ultimately processed by the incinerating mechanism 40.

Referring again to FIGS. 3-11, the incinerating mechanism 40 can take the form of a heater 60 that heats a localized portion 52 of the lint filter 26 and the air around the lint filter 26 to an incinerating temperature 68. This incinerating temperature 68 is configured to incinerate the entrapped lint 32 into the gas byproduct 42. Because the heater 60 heats the air within an incinerating area 62 that surrounds the localized portion 52, the heater 60 can be positioned near the upstream surface 64 of the lint filter 26, where the entrapped lint 32 is typically held. The heater 60 can also be positioned near the downstream surface 66 of the lint filter 26. In each configuration, the heater 60 heats the air within the incinerating area 62 to the incinerating temperature 68 and incinerates the entrapped lint 32. Heaters 60 can also be positioned near each of the upstream and downstream surfaces 64, 66 of the lint filter 26.

Studies related to the incinerating mechanism 40 have shown that the incinerating temperature 68 for incinerating lint particles 30 into the gas byproduct 42 can be approximately 900° C. This temperature can fluctuate depending upon the composition of the lint particles 30, the amount of entrapped lint 32 disposed on the lint filter 26, the speed at which the lint filter 26 operates with respect to the incinerating mechanism 40, and other considerations. The heater 60 causes a thermal degradation of the lint particles 30 that can be converted into the gas byproduct 42. The gas byproduct 42 may also include ash particles that typically have a greatly decreased mass with respect to the entrapped lint 32 that has been incinerated. After the gas byproduct 42 is formed through operation of the incinerating mechanism 40, the gas byproduct 42 can be vented away from the incinerating area 62 using natural thermodynamic venting that moves the gas byproduct 42 through a secondary air path 82. This thermodynamic venting can be a result of the hot gas byproduct 42 being drawn through the flue 84 and toward the lower temperature gas that is present at the end of the flue 84. In various aspects of the device, a secondary blower 80 may be incorporated within the lint disposal mechanism 28 as part of the secondary air path 82 that is adapted to move the gas byproduct 42 from an incinerating area 62 that houses the incinerating mechanism 40. The secondary air path 82 moves the gas byproduct 42 from the incinerating area 62 through an air outlet or flue 84 of the laundry appliance 12. Typically, the flue 84 will deliver the gas byproduct 42 to a separate area within the cabinet of the appliance 12. This gas byproduct 42 may then ultimately dissipate to areas outside of the appliance 12. Accordingly, operation of the thermodynamic venting, or, where applicable, the secondary blower 80, can conveniently move the gas byproduct 42 through the secondary air path 82 and through a separate portion of the appliance 12 or to areas outside of the appliance 12. Incorporation of the secondary air path 82 substantially prevents the gas byproduct 42 from entering into the primary airflow path 22 and the drum 16.

When the heater 60 is used as the incinerating mechanism 40, typically a small localized portion 52 of the lint filter 26 is exposed to the heater 60. Because very high temperatures are experienced within the incinerating area 62, the lint filter 26 is moved away from the incinerating area 62 so that the process air 20 can cool the heated localized portions 52 of the lint filter 26 after leaving the incinerating area 62. As discussed above, only a small portion of the lint filter 26 is typically exposed to the incinerating mechanism 40. Additionally, the lint filter 26 and the incinerating mechanism 40 typically operate at a relatively slow pace with respect to one another. During operation of the incinerating mechanism 40, the lint filter 26 is rotationally operable with respect to the incinerating mechanism 40, or vice versa. According to the various embodiments, the lint filter 26 can rotate at a speed of from approximately one revolution per minute to as slow as approximately 0.1 revolutions per minute (or one revolution every 10 minutes). Typically, the lint filter 26 or the incinerating mechanism 40 operates at a rate of approximately 1 revolution per minute or less. Other speeds of the lint filter 26 can also be used in conjunction with the incinerating mechanism 40. The speed ranges listed above are exemplary in nature. Faster or slower operating speeds can also be used for moving the lint filter 26 with respect to the incinerating mechanism 40. Alternating or varying speeds can be used to move the lint filter 26 in a wide range of conditions where varying amounts of entrapped lint 32 may be held within the surface 44 of the lint filter 26.

By way of example, and not limitation, during laundry cycles that may produce greater amounts of lint particles 30, the lint filter 26 may be operated at a faster speed so that the greater amounts of entrapped lint 32 can be processed by the incinerating mechanism 40. Slower speeds may also be used in instances of greater amounts of entrapped lint 32 so that the incinerating mechanism 40 has a greater amount of time to oxidize the entrapped lint 32 into the gas byproduct 42. In this manner, the surface 44 of the lint filter 26 can be maintained at a substantially unobstructed state 90. During laundry cycles where lesser amounts of lint particles 30 are typically generated, the lint filter 26 may operate at faster or slower speeds depending on the design of the appliance 12, the particular laundry cycle being performed and other considerations. One consistent speed of the lint filter 26 may be utilized during all laundry cycles.

Various aspects of the device can include an automatic and/or manual override that may cause the lint filter 26 to selectively and intermittently rotate at a faster speed in conditions where large amounts of entrapped lint 32 may be held within the surface 44 of the lint filter 26 in an unexpected laundry operating condition. Various sensors can be used in conjunction with a processor to indicate when large quantities of entrapped lint 32 are disposed on the surface 44 of the lint filter 26. In these atypical or unexpected conditions, the processor can cause the motor 50 to operate at a faster speed so that the entrapped lint 32 can be processed by the incinerating mechanism 40 and maintain the lint filter 26 in the substantially unobstructed state 90.

According to various aspects of the device, as exemplified in FIGS. 3-11, the incinerating area 62 of the lint disposal mechanism 28 can be substantially enclosed within or surrounded by an incinerator housing 100. In such an embodiment, the incinerator housing 100 can cover the upstream and downstream surfaces 64, 66 of the lint filter 26 at the localized portion 52 within the incinerating area 62. This incinerator housing 100 serves to confine the gas byproduct 42 within the incinerating area 62 for removal from the incinerating area 62 via the flue 84 rather than being delivered into the airflow path 22. Additionally, by confining the heat 102 within the incinerator housing 100, the incinerating mechanism 40 is able to support localized application of heat 102 within localized portions 52 of the lint filter 26. Additionally, heat 102 generated by the incinerating mechanism 40 can be substantially confined within the incinerating area 62. Because such high levels of heat 102 are generated by the incinerating mechanism 40, maintaining these levels of heat 102 within a confined area can be useful to prevent the process air 20 from being overheated and potentially damaging components of the appliance 12 or the laundry 14 within the rotating drum 16.

Where the incinerating mechanism 40 is a heater 60, the heater 60 can take the form of a ceramic heating element that can be used to generate the incinerating temperatures 68 necessary for incinerating the entrapped lint 32 into the gas byproduct 42. Other electrically resistive heating elements can be used, as well as gas-based or gas-powered heating elements. The various types of heating elements are typically used for generating the incinerating temperature 68 within the incinerating area 62.

Typically, the lint filter 26 can be a stainless steel mesh that is positioned to separate the lint particles 30 from the processed air emanating from the drum 16. The lint disposal mechanism 28 can be located upstream of the blower 18 and consists of the incinerator housing 100 and includes the incinerating mechanism 40. Typically, the incinerating mechanism 40 takes the form of a heater 60 and can include one or more heating elements, such as ceramic heating elements. As discussed above, these heating elements can be used to heat the air within the incinerating area 62 to the appropriate incinerating temperature 68. The incinerating mechanism 40 is adapted to act on a relatively small and localized portion 52 of the lint filter 26. In this manner, the heat 102 generated by the heater 60 can be focused on the localized area of the lint filter 26 that is disposed within the incinerating area 62. By concentrating the heat 102 generated by the incinerating mechanism 40 at this localized area, power consumption can be minimized during use of the incinerating mechanism 40. Using these high temperatures also has the benefits of minimizing or preventing the production of smoke and also minimizing production of offensive solid byproducts. The use of the heater 60 also enables rapid degradation of the entrapped lint 32 from the surface 44 of the lint filter 26.

Referring again to FIGS. 3-11, the incinerator housing 100 can be made of various rigid and heat resistant materials. One such material can be in the form of refractory concrete that has a thickness sufficient to prevent the radiation of heat 102 into the airflow path 22. During an exemplary operation of the incinerating mechanism 40, air within the incinerating area 62 typically reaches approximately 900° C. for approximately two seconds to substantially or completely decompose the entrapped lint 32 and gas byproduct 42 into carbon dioxide and other safe and unobtrusive gasses.

By heating air within the incinerating area 62 to these high temperatures, natural thermal draft may cause an updraft of the air within the incinerating area 62 to be directed through the flue 84 into a separate area of the appliance 12 or out of the appliance 12 altogether. This process may be performed with or without the assistance of the secondary blower 80. The updraft through the incinerating area 62 is also assisted through a combustion inlet 110 where combustion air 112 is directed from outside of the appliance 12. The temperature difference between the cooler combustion air 112 and the heated gas byproduct 42 creates a draft through the incinerating area 62. The dry airstream of cooler combustion air 112 can be used in this manner to move the gas byproduct 42 from the incinerating area 62 and through the flue 84. This combustion air 112 from the combustion inlet 110 can also be used to cool the areas of the lint screen 132 that have just been heated while moving through the incinerating area 62. Typically, the use of the cooler combustion air 112 will cool the localized area of the lint filter 26 to temperatures of approximately 100° C. According to various aspects of the device, this combustion air 112 can also be reclaimed and recirculated back into the incinerating area 62 or to another portion of the appliance 12 so that the heat 102 can be reused to warm other aspects of the appliance 12. In this manner, the reclaimed heat 102 can be used to increase the efficiency of the various heating mechanisms and air-conditioning mechanisms 24 of the appliance 12. By way of example, and not limitation, the heat 102 can be reused within the incinerating area 62 so that the incinerating mechanism 40 can efficiently operate using less electrical power or fuel. In various embodiments of the device, after the combustion air 112 cools the lint screen 132, this combustion air 112 may be preheated within the incinerating area 62. This preheated combustion air 112 can then be recirculated back to the localized area of the lint screen 132 being acted upon by the incinerating mechanism 40 within the incinerating area 62. This preheated combustion air 112 can also be used to heat the process air 20 within the airflow path 22. Various temperature sensors within the incinerating area 62 can cooperate with the heater 60 within the incinerating mechanism 40 to accurately operate the heater 60 to achieve the desired incinerating temperature 68 within the incinerating area 62. After the gas byproduct 42 is generated by the incinerating mechanism 40, the gas byproduct 42 can be directed by the combustion air 112 through the flue 84. A supplemental heater 120 can be disposed within the flue 84 to further decompose all undesirable solids and gasses that may be present within the gas byproduct 42 and the combustion air 112.

Referring again to FIGS. 3-11, the lint screen 132 can include various internal ribs 130 that support the filtering material of the lint screen 132. As discussed above, the lint screen 132 can be in the form of a fine stainless steel woven wire. By way of example, and not limitation, the lint filter 26 can take the form of a 200×200 mesh per inch of 0.0016 inch diameter wire. It should be understood that other variations of the lint screen 132 can be used within the lint disposal mechanism 28. The internal ribs 130 of the lint filter 26 cooperate with the incinerator housing 100. The internal ribs 130 can be sized to operate in conjunction with the incinerator housing 100 so that various filtering sections 146 of the lint filter 26 can be enclosed or substantially sealed within the incinerating area 62. In such an embodiment, the lint filter 26 can operate continuously or can operate intermittently so that each filtering section 146 is temporarily stopped within the incinerating area 62. When stopped in the incinerating area 62, the ribs 130 cooperate with the incinerator housing 100 to substantially generate a seal 140 around the incinerating area 62. In this embodiment, the heater 60 may also operate intermittently when the seal 140 is formed between the ribs 130 and the incinerator housing 100. The internal ribs 130 and the incinerator housing 100 can also cooperate to better direct the flow of the combustion air 112 through the incinerating area 62 and out through the flue 84 of the lint disposal mechanism 28.

The incinerator housing 100 is typically made of a refractory material in areas where there is heat generated. By way of example, and not limitation, the incinerator housing 100 can be made from non-metallic materials that may have a low heat capacity to avoid absorbing and conducting the heat 102 generated by the incinerating mechanism 40. To further assist in the operation of the lint filter 26, a seal 140 can be disposed around the outer edge 142 of the lint filter 26. This outer edge 142 of the lint filter 26, near the seal 140, can include various indentations 144 that can cooperate with the flue 84 of the lint disposal mechanism 28. In such an embodiment, when a particular filtering section 146 of the lint filter 26 that is bound by adjacent ribs 130 is disposed within the incinerating area 62, the indentations 144 within the outer edge 142 of the lint filter 26 can form a portion of the secondary air path 82 that allows for movement of the combustion air 112 through the incinerating area 62 and up through the flue 84 of the lint disposal mechanism 28. As the lint filter 26 rotates, at least one of the indentations 144 is aligned within the secondary air path 82 to promote the flow of combustion air 112 and the gas byproduct 42 carried therein.

Typically, the rotation of the lint filter 26 can be operated through the use of a motor 50, such as a stepper motor, pulley-driven motor, direct drive motor, servo motor, and other similar motors. While rotational operation of the lint filter 26 is described, the lint filter 26 may also be configured for other directional movement with respect to the incinerating mechanism 40. Such movements of the lint filter 26 can be linear movements.

Figure 20:
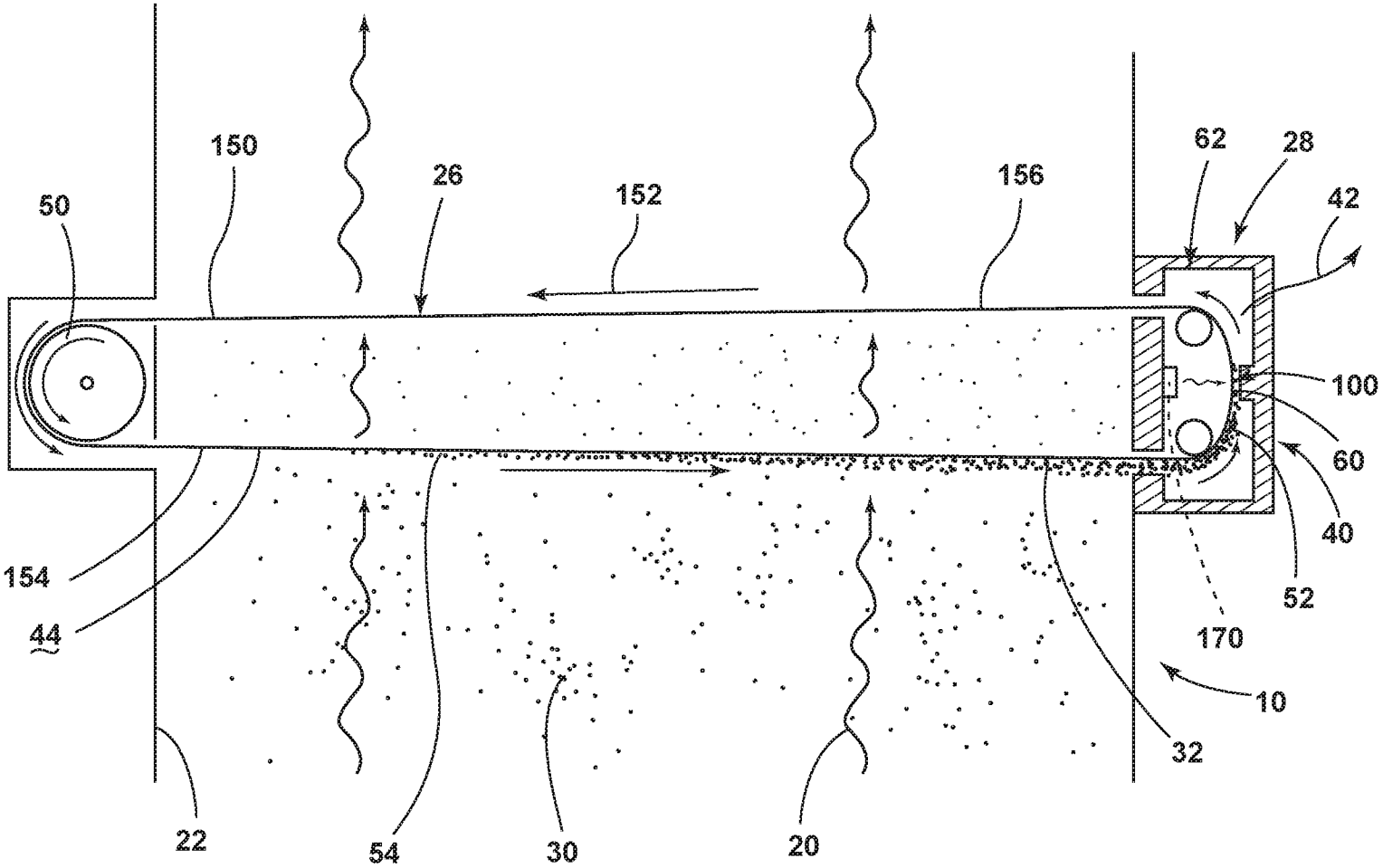
FIG. 20 is a schematic cross-sectional view of an aspect of the lint disposal mechanism.

As exemplified in FIG. 20, the linear movements of the lint filter 26 can be in the form of an elongated lint filter 26 that may be moved vertically or laterally through the airflow path 22 and through the incinerating area 62. In such an embodiment, the lint filter 26 may be configured as a continuous belt 150 that translates in a continuous circuit 152. Such a configuration may provide for two levels of filtering. Where a belt-type filter is used, two portions of the lint filter 26 may be located within the airflow path 22 at any one time. Front and rear sections 154, 156 of the lint filter 26 can be disposed within the airflow path 22 to capture additional portions of the lint particles 30. As the lint filter 26 moves through the continuous circuit 152, the lint filter 26 passes through the incinerator housing 100. Within the incinerator housing 100, the incinerating mechanism 40 operates to degrade the entrapped lint 32 into the gas byproduct 42 that can be carried away by the movement of combustion air 112 through the incinerating area 62.

In various aspects of the device, it is contemplated that the incinerating mechanism 40 can be moved with respect to the lint filter 26. In such an embodiment, the lint filter 26 may be stationary and the incinerating mechanism 40 can operate in a rotational or linear path within the airflow path 22. Typically, it is the lint filter 26 that will operate with respect to the lint disposal mechanism 28.

As exemplified in FIGS. 3-10 and 12, the incinerating mechanism 40 can take the form of one or more electrodes 170 that can operate within the incinerating area 62 to produce an arcing electrical current 172 between each electrode 170 and the material of the lint filter 26. In such an embodiment, the arcing electrical current 172 operates to incinerate the particles of entrapped lint 32 into the gas byproduct 42.

Referring again to FIGS. 3-10 and 12, the incinerating mechanism 40 can include a plurality of electrodes 170 that act within the localized area within the incinerating area 62. The electrodes 170 receive an electrical current 180 from a power system 182 (shown schematically in FIG. 2) for the appliance 12. This electrical current 180 generates an arcing electrical current 172 from the electrodes 170 and to a surface 44 of the lint filter 26. As the arcing electrical current 172 moves to the surface 44 of the lint filter 26, this arcing electrical current 172 moves through the entrapped lint 32. The entrapped lint 32 is thereby incinerated into the gas byproduct 42. The placement of the electrode 170 within the incinerating area 62 can vary depending upon the configuration of the lint filter 26 and other considerations.

In various aspects of the device, it is also contemplated that the individual electrodes 170 can be moved within the incinerating area 62. By way of example, and not limitation, the various electrodes 170 can be moved within the incinerating area 62 in a generally recirculating path to achieve the most complete coverage by the arcing electrical current 172 with respect to the surface 44 of the lint filter 26. The recirculating path can be in the form of a reciprocating linear motion, an elliptical motion, a generally arcuate motion, and other similar movements of the electrodes 170 within the incinerating area 62. In various aspects of the device, the electrodes 170 may also take the form of one or more bar electrodes 170, as well as other electrodes 170 having various shapes, sizes and configurations.

Where the incinerating mechanism 40 includes the plurality of electrodes 170, the housing can include the combustion inlet 110 that allows combustion air 112 from the exterior of the appliance 12 to move through the incinerating area 62 and up through the flue 84 of the lint disposal mechanism 28. Combustion air 112 serves to eliminate the various byproducts, including the gas byproducts 42, that are generated through the use of this incinerating mechanism 40 from the airflow path 22. Again, the flue 84 can include a supplemental heater 120 that can be used to decompose the gas byproducts 42, and other byproducts that may be present, into carbon dioxide or other similar non-nuisance gasses that can be responsibly directed back into the surrounding environment.

As exemplified in FIGS. 3-10 and 12, the incinerating mechanism 40 that utilizes the plurality of electrodes 170 can be substantially stationary and the lint filter 26 can operate within the airflow path 22 so that varying portions of the lint filter 26 can be acted upon by the plurality of electrodes 170. In various aspects of the device, the plurality of electrodes 170 can be moved within the airflow path 22 to act upon a stationary lint filter 26. It is typical that the lint filter 26 will be movable within the airflow path 22 and that incinerating mechanism 40 will be substantially stationary within the airflow path 22. As discussed above, it is contemplated that the plurality of electrodes 170 may be operable within the incinerating area 62 so that substantially all of the lint within the incinerating area 62 can be disintegrated by the incinerating mechanism 40.

In the various embodiments, the lint disposal mechanism 28 utilizing the plurality of electrodes 170, the lint filter 26 is typically a stainless steel mesh or other similar metallic mesh that can be used in conjunction with electrodes 170 to generate the arcing electrical current 172. The plurality of electrodes 170 are typically spaced relatively close to the surface 44 of the lint filter 26. In this manner, the arcing electrical current 172 can be conveniently generated between the electrodes 170 and the surface 44 of the lint filter 26. When the electrodes 170 generate arcing electrical current 172, lint particles 30 that are aligned beneath or adjacent to the electrodes 170 are incinerated or electrolyzed. By electrolyzing the entrapped lint particles 30, the arcing electrical current 172 serves to decompose these lint particles 30 into various byproducts that typically include gas byproducts 42. Again, these gas byproducts 42 can be further decomposed through the supplemental heater 120 that is disposed within the flue 84 of the lint disposal mechanism 28.

While the term gas byproduct 42 is used in the various embodiments to describe the remnants left of the lint particles 30 after being acted upon by the incinerating mechanism 40, various ash, and other ultra-fine particulate matter may also be generated as a byproduct. The byproducts generated during operation of the incinerating mechanism 40 are typically light enough that the combustion air 112 conveniently moves these byproducts along with the gas byproduct 42 from the incinerating area 62 and through the flue 84 of the lint disposal mechanisms 28. As discussed above, a supplemental heater 120 can be included within the flue 84 to further degrade the various byproducts.

Referring now to FIGS. 1, 2 and 13-16, the lint disposal mechanism 28 can include a lint removal apparatus 210. This lint removal apparatus 210 can be configured to move entrapped lint particles 30 from a surface 44 of the lint filter 26 to a separate area. This separate area can typically be in the form of a compactor 212 that operates within a compacting chamber 214. In such an embodiment, the compactor 212 operates to compact the removed lint 216 that is disposed within the compacting chamber 214 into a compressed lint pellet 218 that can then be disposed within a removable or emptyable holding compartment 220.

As exemplified in FIGS. 13-16, during operation of the laundry appliance 12, lint particles 30 can engage the lint filter 26 and take the form of entrapped lint 32 on a surface 44 of the lint filter 26. The lint removal apparatus 210 can be utilized to remove the entrapped lint 32 and place the entrapped lint 32 as removed lint 216 into the compacting chamber 214. This lint removal apparatus 210 can take the form of any one of various mechanisms. Such mechanisms can include, but are not limited to, lint scrapers that act upon a surface 44 of the lint filter 26, as exemplified in FIG. 17, a stationary lint screen 132 that acts upon an operable lint filter 26, as exemplified in FIG. 18, concentrated streams of air that act upon the entrapped lint 32, fluid streams that act upon the entrapped lint 32, a cyclonic separator 230, as exemplified in FIG. 19, combinations thereof, and other similar lint removal configurations.

As exemplified in FIGS. 13-16, the compactor 212 acts upon the removed lint 216 within the compacting chamber 214 and exerts a compressive force 240 onto the removed lint 216. This compressive force 240 is typically sufficient enough to compact the lint particles 30 into the compressed lint pellet 218. The compressed lint pellet 218 is configured so that it does not experience any rebound or only very minimal amounts of rebound where the compressed lint pellet 218 may expand into a larger volumetric configuration. The compressed lint pellet 218, once fully compressed, can then be dropped or otherwise ejected into a holding compartment 220 disposed within the appliance 12.

The amount of compressive force 240 exerted by the compactor 212 can be a consistent compressive force 240 that can achieve the non-rebounding or substantially non-rebounding formation of the compressed lint pellet 218. This compressive force 240, based upon testing performed on various aspects of the lint disposal mechanism 28, has been shown to be from approximately 6.5 pounds per square inch to approximately 9.8 pounds per square inch to achieve the compressed lint pellets 218 using various compositions of lint. These compressive forces 240 can be used to achieve a density of the compressed lint pellet 218 that is from approximately 3 grams per cubic centimeter to approximately 9 grams per cubic centimeter. This range in density has been shown to achieve the non-rebounding or substantially non-rebounding configuration of the compressed lint pellets 218.

As exemplified in FIGS. 13-16, the lint disposal mechanism 28 incorporating a compactor 212 can include an inlet door 250 that receives the entrapped lint 32 from the surface 44 of the lint filter 26 and allows this entrapped lint 32 to be moved into the compacting chamber 214 as removed lint 216. This lint movement to the compacting chamber 214 is moved through the inlet door 250 and is placed therein in the form of removed lint 216 that can then be acted upon by the compactor 212. The inlet door 250 can then be closed and the compactor 212 actuated so that the compressive force 240 can be exerted upon the removed lint 216 to generate the compressed lint pellet 218. An outlet door 252 can then be operated so that the compressed lint pellet 218 can be dropped or otherwise ejected into the holding compartment 220.

According to various aspects of the device, the holding compartment 220 can be adapted to be a non-removable chamber that receives the formed compressed lint pellet 218 through the life of the appliance 12. Stated another way, the holding compartment 220 can be configured to not be emptied during the life of the appliance 12. According to various aspects of the device, the holding compartment 220 can also be configured to be periodically removed and emptied by a user of the appliance 12.

Where the compressed lint pellets 218 are disposed within a holding compartment 220 that is not removed but is added to over the life of the product, studies have shown that the size of the compressed lint pellets 218 that may be accumulated over approximately 5,000 drying cycles may require approximately 2,300 cubic centimeters of space. Larger or lesser amounts of space may be needed depending upon the amount of cycles and the nature of the lint being compressed into the compressed lint pellets 218. However, studies have shown that the amount of lint that may be accumulated over the life of the appliance 12 will typically not exceed a volume of approximately 7,500 cubic centimeters, which is approximately the size of twelve soda cans.

The various compactors 212 that can be used within the lint disposal mechanism 28 can take the form of an operable piston 260, rolling compactors, folding-type compactors, combinations thereof, and other similar compacting mechanisms. During the process of compacting the removed lint 216 into the compressed lint pellet 218, the removed lint 216 can be compressed in a dry state where no moisture is added to the removed lint 216. It is also contemplated that the removed lint 216 can be combined with various amounts of moisture to assist in compaction of removed lint 216 into the compressed lint pellets 218.

Figure 19:
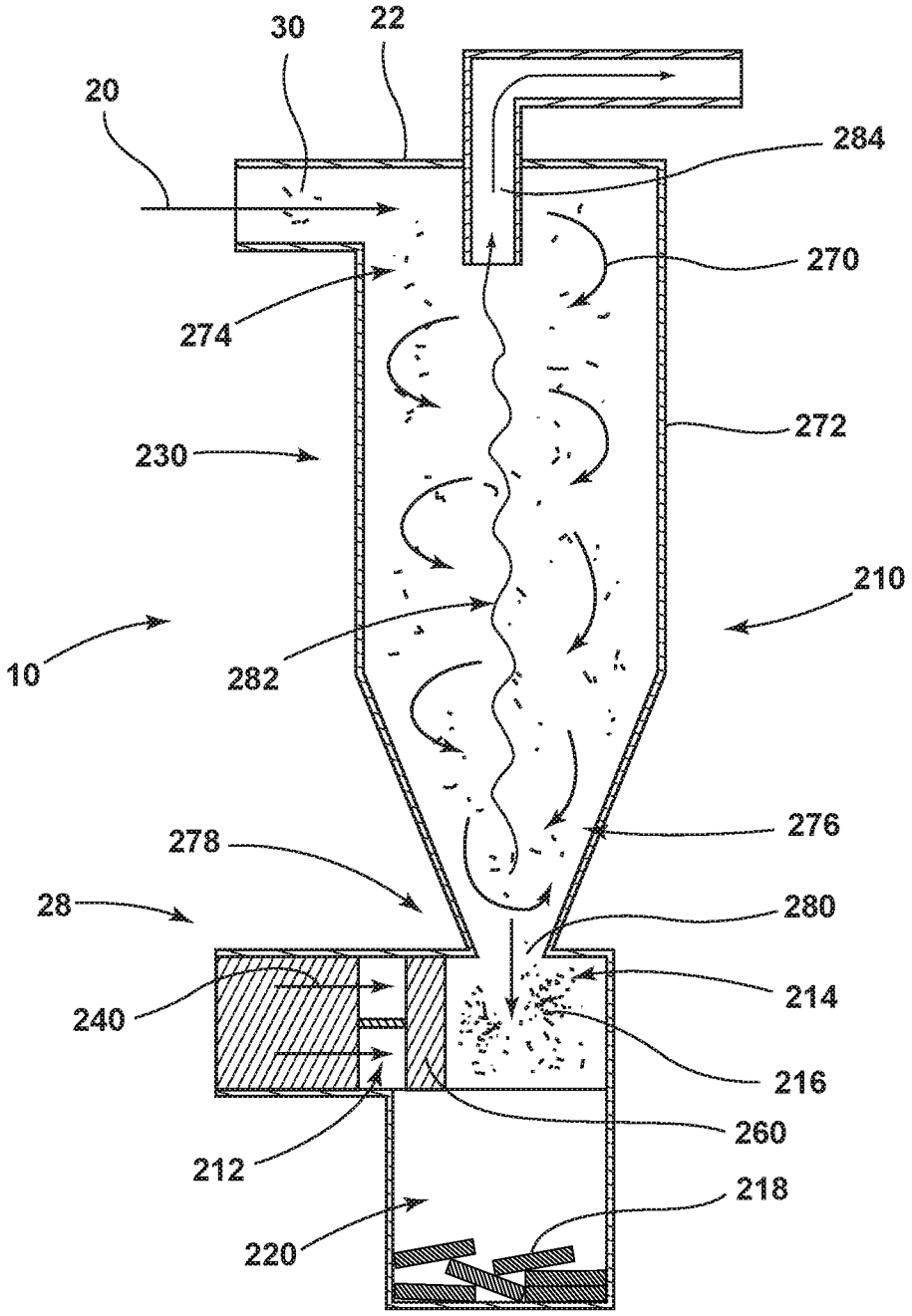
FIG. 19 is a schematic representation of a cyclonic particle separator for removing lint particles to a compacting chamber in the absence of a filtering lint screen.

As exemplified in FIG. 19, the lint filter 26 can take the form of a cyclonic separator 230 that can be used to separate the lint particles 30 for disposal into a compacting chamber 214. The cleaned process air 20 that is substantially free of lint particles 30 can then be moved back through the drum 16 of the appliance 12. This cyclonic separator 230 can use a high speed rotating or helical airflow 270 that is established within the conical container known as a cyclone 272. As the process air 20 containing a particulate material moves through the helical airflow 270 of the cyclone 272, the process air 20 moves in the helical path from the wide end 274 of the cyclone 272 at the top and toward the narrow end 276 of the cyclone 272 at the bottom. At this bottom portion 278 of the cyclone 272, gravity and friction acts upon the lint particles 30 within the helical airflow 270 and causes them to drop through a lower outlet 280 of the cyclone 272 into a compacting chamber 214. Within this compacting chamber 214, the compactor 212 can act upon the removed lint 216 to produce the compressed lint pellet 218 that can then be disposed, typically within the holding compartment 220. The cleaned process air 20 is then moved upward through the center of the cyclone 272 as return air 282. This return air 282 is moved through a cyclone outlet 284 for delivery to the drum 16.

In various aspects of the device, the cyclonic separator 230 can also take the form of a fluid spray that saturates various lint particles 30 entrapped within the process air 20. These saturated lint particles 30 can then be dropped into a compaction chamber for compression into the compressed lint pellets 218. The fluid spray can act as a lint filter 26 of the appliance 12 or can operate in conjunction with a separate lint filter 26.

According to various aspects of the device, the removed lint 216 disposed within the compacting chamber 214 as well as the compressed lint pellets 218 disposed within the holding compartment 220 can also be acted upon by at least one of the incinerating mechanisms 40 described herein. In such an embodiment, lint particles 30 can be placed into one of these separate compartments. Within this compartment, the compacting chamber 214 and/or the holding compartment 220, the incinerating mechanism 40 can be placed adjacent thereto so that the incinerating mechanism 40 can act upon the removed lint 216 to incinerate the removed lint 216 into the gas byproduct 42. In such an embodiment, the compacting chamber 214 and/or the holding compartment 220 can be configured as a separate and substantially heat-resistant compartment within which the incinerating temperatures 68 can be reached or the arcing electrical current 172 can be used to degrade the lint particles 30 into the gas byproduct 42. The flue 84 can also be coupled with the compacting chamber 214 or holding compartment 220 so that the gas byproduct 42 can be further degraded by the supplemental heater 120 and removed from the appliance 12.

According to various aspects of the device, the lint disposal mechanism 28 can be used within various appliances 12. Such appliances 12 can include, but are not limited to, heat pump dryers, exhaust dryers, combination washing/drying appliances, appliances that incorporate a heat pump system, appliances 12 that incorporate an air-to-air heat exchanger, refrigerating appliances, freezers, combinations thereof, and other similar appliances. It is also contemplated that various aspects of the lint disposal mechanism 28 can be included within air handling systems, such as air conditioners, furnaces, air filtration devices, air sanitizers, combinations thereof and other similar air-handling systems.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A laundry appliance comprising:

a drum for processing laundry;

a blower that delivers process air through an airflow path that includes the drum;

a lint filter positioned within the airflow path that separates particulate matter from the process air; and a lint disposal mechanism that removes entrapped lint particles from a surface of the lint filter, wherein the lint disposal mechanism includes a plurality of electrodes that each selectively produce an arcing electrical current between a respective electrode of the plurality of electrodes and a dedicated localized area of the lint filter, wherein the arcing electrical current is operated to incinerate the entrapped lint particles into at least a gas byproduct, wherein the lint disposal mechanism heat a portion of the lint filter to an incinerating temperature that is configured to incinerate the entrapped lint particles into at least the gas byproduct, and wherein the lint disposal mechanism defines as incinerating area that operates relative to the lint filter, wherein the incinerating area is substantially surrounded by an incinerator housing that includes a flue that is defined within a secondary air path, separate from the airflow path, and through which the gas byproduct is delivered from the incinerating area to an area external to the laundry appliance.

2. The laundry appliance of claim 1, wherein the lint filter rotates through the incinerating area.

3. The laundry appliance of claim 1, wherein the incinerator housing includes a combustion inlet that directs combustion air from outside the incinerator housing into the incinerating area.

4. The laundry appliance of claim 3, wherein the combustion air and the gas byproduct are delivered from the incinerating area to the flue.

5. The laundry appliance of claim 2, wherein the incinerator housing is positioned within a portion of the airflow path.

6. The laundry appliance of claim 5, wherein the airflow path directs the process air around the incinerator housing and through a portion of the lint filter that is outside of the incinerator housing.

7. The laundry appliance of claim 2, wherein the incinerator housing is positioned outside of the airflow path.

8. A laundry appliance comprising:

a drum for processing laundry;

a blower that delivers process air through an airflow path that includes the drum, wherein the process air transports particulate material from the drum and into the airflow path;

a lint separator positioned within the airflow path that separates the particulate material from the process air; and a lint disposal mechanism that removes entrapped lint particles from the lint separator, wherein the lint disposal mechanism includes an incinerating mechanism that includes a plurality of electrodes that are each configured to act on a dedicated localized area of the lint separator to produce a gas byproduct, wherein an incinerator housing defines an incinerating area that includes the plurality of electrodes, and wherein the incinerator housing includes a flue that is defined within a secondary air path, separate from the airflow path, and through which the gas byproduct is delivered from the incinerating area to an external to the laundry appliance.

9. The laundry appliance of claim 8, wherein the lint separator includes a lint filter that is positioned within the airflow path proximate the plurality of electrodes.

10. The laundry appliance of claim 9, wherein the lint filter rotates through the incinerator housing and the incinerating area.

11. The laundry appliance of claim 8, wherein the incinerator housing is positioned within a portion of the airflow path.

12. The laundry appliance of claim 10, wherein the airflow path directs the process air around the incinerator housing and through a portion of the lint filter that is outside of the incinerator housing.

13. The laundry appliance of claim 8, wherein the incinerator housing is positioned outside of the airflow path.

* * * * *